US008213842B2

(12) United States Patent
Usui

(10) Patent No.: US 8,213,842 B2
(45) Date of Patent: Jul. 3, 2012

(54) TONER CARTRIDGE, AND PROCESS UNIT AND IMAGE FORMING APPARATUS USING THE SAME

(75) Inventor: Tomoya Usui, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 435 days.

(21) Appl. No.: 12/493,569

(22) Filed: Jun. 29, 2009

(65) Prior Publication Data

US 2009/0324297 A1 Dec. 31, 2009

(30) Foreign Application Priority Data

Jun. 27, 2008 (JP) ..... P2008-169642

(51) Int. Cl.
*G03G 15/08* (2006.01)

(52) U.S. Cl. ..... 399/262

(58) Field of Classification Search ..... 399/254, 399/256, 263, 262

See application file for complete search history.

(56) References Cited

U.S. PATENT DOCUMENTS

| | | | | |
|---|---|---|---|---|
| 6,038,422 | A | 3/2000 | Loewel | |
| 7,412,192 | B2 * | 8/2008 | Nakajima et al. | 399/262 |
| 2002/0127032 | A1 * | 9/2002 | Ban et al. | 399/262 |
| 2006/0133856 | A1 | 6/2006 | Deguchi et al. | |
| 2006/0165441 | A1 | 7/2006 | Deguchi | |
| 2007/0280743 | A1 | 12/2007 | Nakajima et al. | |
| 2008/0304870 | A1 | 12/2008 | Nakajima et al. | |
| 2008/0304871 | A1 | 12/2008 | Nakajima et al. | |
| 2008/0304872 | A1 | 12/2008 | Nakajima et al. | |

FOREIGN PATENT DOCUMENTS

| | | | |
|---|---|---|---|
| JP | 03271782 | A * | 12/1991 |
| JP | 6-222665 | | 8/1994 |
| JP | 8-076575 | A | 3/1996 |
| JP | 8-305149 | | 11/1996 |
| JP | 2000-39760 | A | 2/2000 |
| JP | 2002-214893 | A | 7/2002 |
| JP | 2004-271995 | | 9/2004 |
| JP | 2006-178438 | A | 7/2006 |

* cited by examiner

*Primary Examiner* — David Gray
*Assistant Examiner* — Ruth Labombard
(74) *Attorney, Agent, or Firm* — Nixon & Vanderhye P.C.

(57) ABSTRACT

A toner cartridge, and a process unit and image forming apparatus using the same. Toner contained in an outer chamber is scooped with a toner scooping member by rotation of a toner container and slides down toward a communication port along an upper surface of a partition, and falls down to an inner chamber from the communication port. Then, the toner that has fallen down into the inner chamber from the communication port slides down toward a toner discharging port along the inner surface of the partition, and is discharged from the toner discharging port. Furthermore, toner discharged form the toner discharging port is discharged from a toner through hole provided in a toner container supporting member to the outside of the toner cartridge.

10 Claims, 20 Drawing Sheets

TONER CARTRIDGE, AND PROCESS UNIT AND IMAGE FORMING APPARATUS USING THE SAME

CROSS REFERENCE TO RELATED APPLICATION

This application claims priority to Japanese Patent Application No. 2008-169642, which was filed on Jun. 27, 2008, the contents of which are incorporated herein by reference in its entirety.

BACKGROUND OF THE INVENTION

1. Field of the Invention

The present invention relates to a toner cartridge, and a process unit and image forming apparatus using the same. In particular, the invention relates to the toner cartridge used for an image forming apparatus by means of toner, and a process unit and image forming apparatus using the same.

2. Description of the Related Art

The image forming apparatus such as a copier and a facsimile apparatus is designed for continuously operating output of images by supplying a developing apparatus with the toner by a toner replenishing apparatus using such as the toner cartridge.

Recently, as a toner replenishing method to the developing apparatus, a method that replaces an empty toner cartridge with a new one becomes mainstream, instead of a method that replenishes the toner from a toner container to a toner hopper. According to this method, it is possible to supply the toner without smearing an operator's hands.

However, in such a toner cartridge, there may arise a problem that the toner is aggregated to one another and solidified due to its own weight and, as a consequence, cannot be smoothly replenished to the inner portion of the image forming apparatus. In addition, a toner cartridge provided with an agitating propeller in the toner cartridge for agitating the toner is known, but this type of toner cartridge is rather expensive.

In order to solve such a problem, Japanese Unexamined Patent Publication JP-A 2004-271995 discloses a toner cartridge which has a cylindrical shape with a bottom and a spiral projection which is formed on an inner surface of the toner cartridge and projects inward. The toner cartridge disclosed in JP-A 2004-271995 rotates about its axis in the image forming apparatus for conveying the toner by the spiral projection and feeding the toner to the main body of the image forming apparatus.

According to this method, it is possible with a low-cost apparatus configuration to prevent aggregation of the toner in the toner cartridge and to supply the toner smoothly. Further, this toner cartridge can be rotated by supplying a driving force from an end thereof. Therefore, with this toner cartridge, a toner replenishing apparatus that suppress the toner aggregation can be obtained without a complicated toner agitating mechanism.

However, the toner cartridge disclosed in JP-A 2004-271995 has a problem that the toner adheres to and remain unfed around the projection (hereinafter, referred to as toner guide projection) which is provided, as a means to convey the toner toward a toner discharging port, at an inner wall of the toner cartridge and formed in spirals.

In particular, when the quantity of toner in the toner cartridge is decreased, there may arise a problem described below. The toner cartridge has two concavities (back sides of the toner guide projection) therein composed across a base part of the projection. The toner easily adheres to a more distant concavity from the toner discharging port (a concavity disposed at upstream side of toner conveying direction) because the toner rarely contacts with (is rubbed by) toner in fluidized state. As a result, the quantity of the toner remains unfed is increased.

SUMMARY OF THE INVENTION

An object of the invention is, therefore, to provide a toner cartridge capable of reducing the quantity of toner that remains in the toner cartridge without being discharged therefrom, a process unit and image forming apparatus using the same.

The invention provides a toner cartridge mounted removably in an image forming apparatus, comprising:

a toner container, formed into a cylindrical shape, for containing a toner for use as a developer in image formation, the toner container having a toner discharging port through which the toner is discharged and conveying the contained toner toward the discharging port by rotation of the toner container about an axis thereof; and a toner container supporting member for supporting the toner container rotatably about the axis thereof, throughout a whole circumference from an outer side in a radial direction of the toner container, the toner container supporting member having a toner through hole for guiding the toner discharged from the toner discharging port to the outside of the toner cartridge, the toner container including a cylindrical outer wall and a cylindrical partition provided inside the cylindrical outer wall, an inner diameter of which becomes smaller with distance from the toner discharging port in an axial direction of the toner container, the toner container having an inner chamber formed by being surrounded by the partition and an outer chamber formed by being surrounded by the outer wall and an outer surface of the partition, the partition having a communication port arranged at a position distant from the toner discharging port in the axial direction and used as an opening through which the toner is supplied from the outer chamber toward the inner chamber, and between the outer wall and the partition, a toner scooping member being arranged for scooping the toner in the outer chamber and guiding the toner to the communication port by the rotation of the toner container.

According to the invention, the toner cartridge mounted removably in the image forming apparatus comprises a toner container that conveys the contained toner toward a toner discharging port by rotation; and a toner container supporting member for supporting the toner container rotatably, having a toner through hole for guiding the toner discharged from the toner discharging port to the outside. Further, the toner container comprises a cylindrical outer wall and a cylindrical partition provided inside the cylindrical outer wall, an inner diameter of which becomes smaller with distance from the toner discharging port in an axial direction of the toner container, and the toner container has an inner chamber formed by being surrounded by the partition and an outer chamber formed by being surrounded by the outer wall and an outer surface of the partition. The partition included in the toner container has a communication port arranged at a position distant from the toner discharging port in the axial direction and used as an opening through which the toner is supplied from the outer chamber toward the inner chamber. Furthermore, between the outer wall and the partition, a toner scooping member is arranged for scooping the toner in the outer chamber and guiding the toner to the communication port by the rotation of the toner container.

In such a toner cartridge, the toner contained in the outer chamber is scooped by the toner scooping member with the rotation of the toner container, slides down the outer surface of the downwardly-inclined partition toward the communication port, and falls down into the inner chamber through the connection port. The toner that has fallen down into the inner chamber through the communication port slides down toward the toner discharging port along a downwardly-inclined inner surface of the partition, which lies below with respect to the surface that is disposed with the communication port in the partition, and the toner is discharged from the toner discharging port. Then, the toner is discharged toward the outside of the toner cartridge via a toner through hole provided in a toner container supporting member.

As described above, even if the inner surface of the toner container does not have the projections for conveying toner, the toner contained in the toner container is conveyed, sliding down the surface of the partition by its own weight. As a result, the adhesion of the toner around the projections for conveying toner is prevented and the quantity of the toner that remains in the toner container without being discharged therefrom can be reduced.

Further in the invention, it is preferable that the communication port in the partition is arranged at a farthest position from the toner discharging port in the axial direction.

According to the invention, the communication port in the partition is arranged at a farthest position from the toner discharging port in the axial direction. Thereby, since the communication port is provided at an end portion in the partition, it is possible to supply all of the toner in the outer chamber to the inner chamber and reduce the quantity of the toner that remains in the toner container without being discharged.

Further, in the invention, it is preferable that the inner chamber has a truncated cone shape.

According to the invention, the inner chamber has a truncated cone shape. Thereby, since there is less adhesion of toner to a tip portion of the inner chamber compared to the case in which the inner chamber has a cone shape with a cone point, the quantity of the toner that remains in the toner container without being discharged therefrom can be reduced.

Further, in the invention, it is preferable that the inner chamber has a tip portion of an oval shape or a polygonal shape.

According to the invention, the inner chamber has a tip portion of an oval shape or a polygonal shape. Thereby, since there is less adhesion of toner to the tip portion of the inner chamber due to a bulk flow of the toner at the corner of the inner chamber caused by the rotation of the toner container, the quantity of the toner that remains in the toner container without being discharged therefrom can be reduced.

Further, in the invention, it is preferable that the toner scooping member is provided adjacently to the communication port over an entire length in the axial direction and is a plate-shaped member extending from the partition toward the outer wall.

According to the invention, the toner scooping member is provided adjacently to a communication port over an entire length in the axial direction and is a plate-shaped remember extending from the partition toward the outer wall. In this way, by the toner scooping members formed with no space between the partition and the outer wall over the entire length in the axial direction, the toner scooping member can convey all of toner in the outer chamber toward the communication port.

Furthermore, in the invention, it is preferable that the toner scooping remember is continuously formed spirally around the axis of the toner container.

According to the invention, the toner scooping member is continuously formed spirally around the axis of the toner container. Thereby, the toner in the outer chamber can be conveyed immediately toward a communization port.

Furthermore, in the invention, it is preferable that the toner scooping member is formed with a notch in a middle of the surface thereof.

According to the invention, the toner scooping member is formed with a notch in a middle of the surface thereof. Thereby, since a part of the toner in the outer chamber passes through the notch, the toner in the outer chamber remains in fluidized state without coagulating.

Furthermore, in the invention, it is preferable that the toner scooping member is formed in a comb-like shape.

According to the invention, the toner scooping member is formed in a comb-like shape. Thereby, the toner in the outer chamber is broken and prevented front coagulating.

Further, the invention provides a process unit for forming a toner image by supplying toner as a developer to a surface of a photoreceptor included in an image forming apparatus and visualizing an electrostatic latent image formed on the surface of the photoreceptor, comprising:

the toner cartridge mentioned above that contains toner therein; and a developing section for developing the electrostatic latent image by supplying toner to the surface of the photoreceptor.

According to the invention, there is provided a process unit comprising the toner cartridge that contains toner therein; and a developing section for developing the electrostatic latent image by supplying toner to the surface of the photoreceptor. This process unit can be realized by using the toner cartridge.

Furthermore, the invention provides an image forming apparatus carrying out an image formation by electrophotography, comprising:

a photoreceptor as an image bearing member;

a charging portion for charging a surface of the photoreceptor;

an exposure portion for irradiating a surface of the photoreceptor in a charged state with a signal light corresponding to an image information to form an electrostatic latent image; and the process unit mentioned above for forming a toner image by supplying toner as a developer to the electrostatic latent image on the surface of the photoreceptor.

According to the invention, the image forming apparatus carrying out an image formation by electrophotography can be realized by including the process unit mentioned above.

BRIEF DESCRIPTION OF DRAWINGS

Other and further objects, features, and advantages of the invention will be more explicit from the following detailed description taken with reference to the drawings wherein.

DETAILED DESCRIPTION

Figure 1:
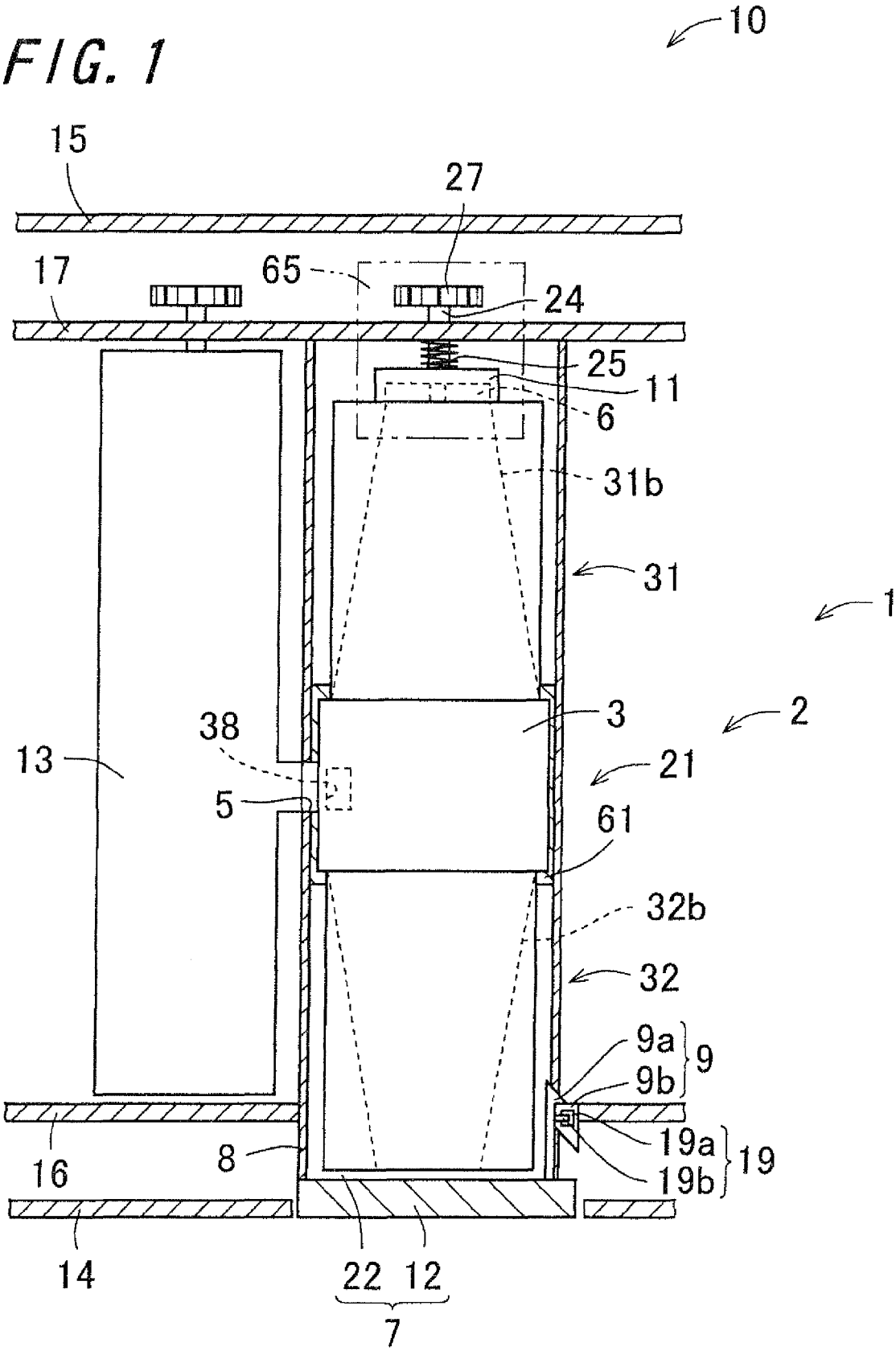
FIG. 1 is a view showing the structure of a main part of the process unit according to an embodiment of the invention.

Now referring to the drawings, preferred embodiments of the invention are described below.

FIG. 1 is a view showing the structure of a main part of a process unit 10 according to an embodiment of the invention. The process unit 10 supplies toner as a developer, to a surface of a photoreceptor durum 44 included in an image forming apparatus 100 described below. The process unit 10 then forms a toner image by visualizing an electrostatic latent image formed on the surface of a photoreceptor durum 44. In the image forming apparatus 100, the process unit 10 is disposed adjacently to the photoreceptor durum 44. In addition, the process unit 10 comprises a toner cartridge 1, a container supporting member 7, a toner hopper 13, and a developing section 47 (see FIG. 18).

The container supporting member 7 supports the toner cartridge 1 described later and fixes it to a predetermined position in the container supporting member 7. The container supporting member 7 has a bottom wall portion 22 and a container fixing section 61.

The bottom wall portion 22 extends in a rotational axial direction of the toner cartridge 1 in accordance with the toner cartridge 1, and constitutes a mounting portion to place the toner cartridge 1. The container fixing portion 61 disposed on the bottom wall portion 22 removably holds a toner container supporting member 3 of the toner cartridge 1 and firmly secures the toner cartridge 1 so that it does not move in the rotational axial direction.

Here, description will hereinafter be given for a position at which the bottom wall portion 22 is disposed in an image forming apparatus 100 described below, that is, a position at which the toner cartridge 1 mounted in the bottom wall portion 22 is disposed. In the image forming apparatus 100, a housing is arranged inside an outer covering portion covering an outer circumference of the image forming apparatus 100, and the process unit 10 is disposed in the housing. As shown in FIG. 1, the outer covering portion has a front outer covering portion 14 and a back outer covering portion 15 facing each other. The front outer covering portion 14 is a part positioned at the front of a user of the image forming apparatus 100. Furthermore, the back outer covering portion 15 is a part corresponding to a back side of the image forming apparatus 100 when viewed from the user in the side of the front outer covering portion 14. Moreover, the housing arranged inside the outer covering portion has a housing front portion 16 facing the front outer covering portion 14 and a housing back portion 17 facing the back outer covering portion 15.

The bottom wall portion 22 of the container supporting member 7 that fixes and supports the toner cartridge 1 has both ends in the direction extending in response to the rotational axial direction of the toner cartridge 1 (extending direction), and one end is connected to the housing back portion 17 and the other end is connected to a front wall portion 12 as a part of the front outer covering portion 14 through the housing front portion 16.

In addition, the front wall portion 12 is formed with a handle (not shown) at a front thereof, and the bottom wall portion 22 further has two guides members 8 extending in the extending direction at a side surface thereof. The guide member 8 can be extended and contracted in the extending direction, and the toner cartridge 1 fixed to the bottom wall portion 22 is allowed to moved freely in the extending direction with the guide members a are extended and contracted.

Figure 2:
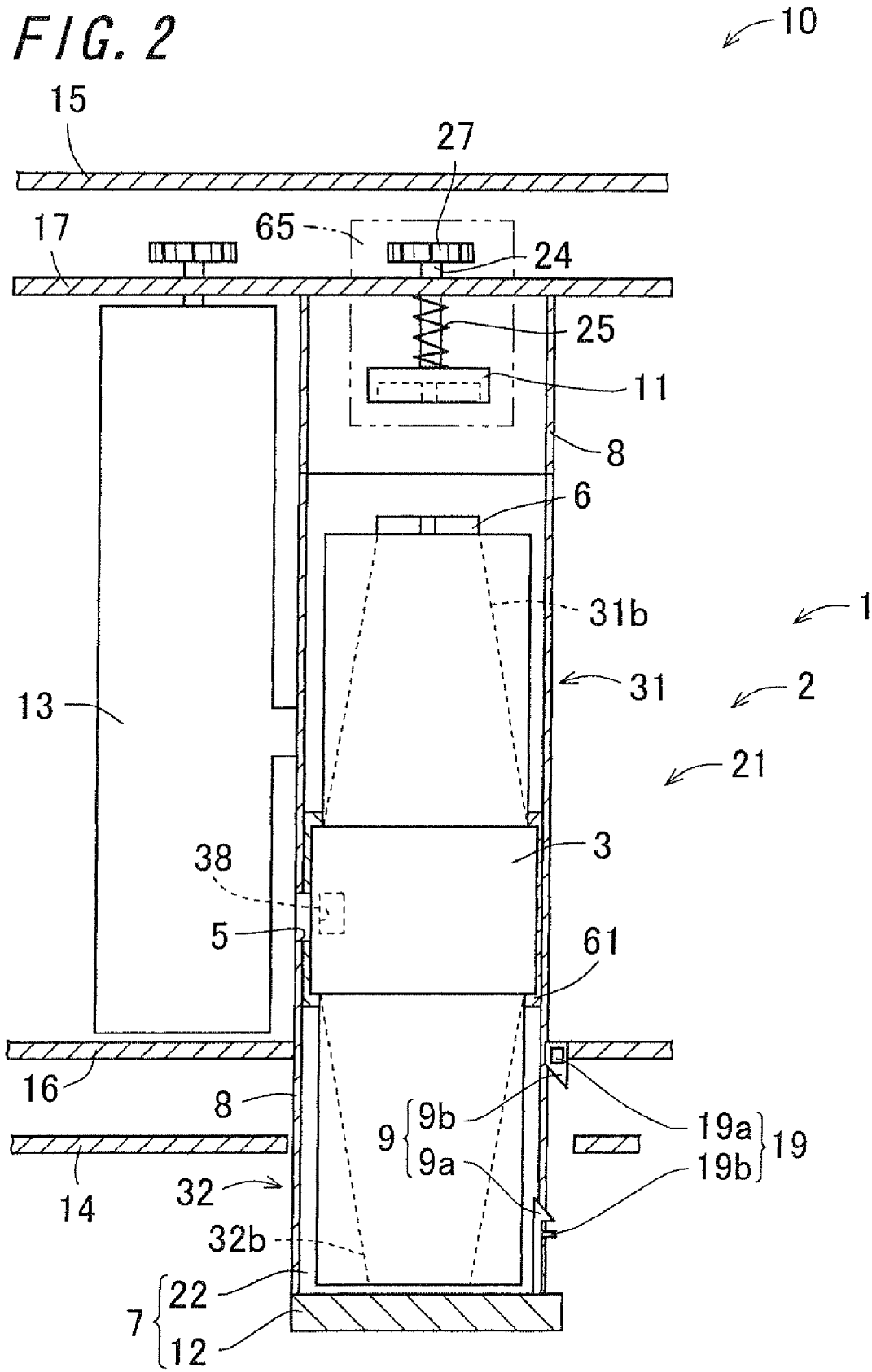
FIG. 2 is a view showing that a toner cartridge fixed to a container supporting member is separated from a main body of an image forming apparatus.
Figure 3:
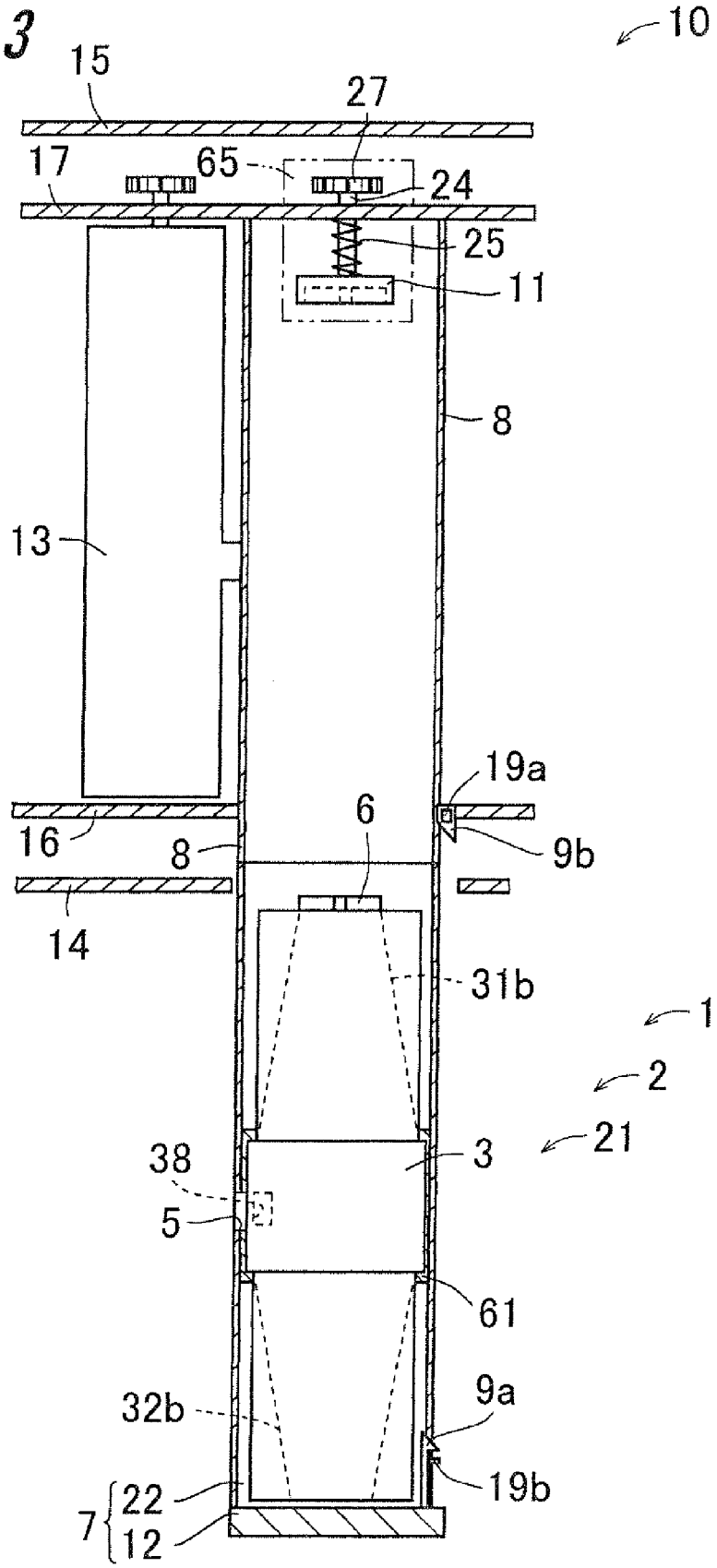
FIG. 3 is a view showing that the toner cartridge fixed to the container supporting member is pulled out of the main body of the image forming apparatus.

FIG. 2 is a view showing that the toner cartridge fixed to the container supporting member 7 is separated from the main body of the image forming apparatus. In addition, FIG. 3 is a view showing that the toner cartridge fixed to the container supporting member 7 is pulled out of the main body of the image forming apparatus.

When a user in the side of the front outer covering portion 14 pulls the handle formed on the front wall portion 12 in a forward direction (in a front direction), the toner cartridge 1 fixed to the bottom wall portion 22 of the container supporting member 7 can be separated from the housing back portion 17 and to be pulled out to a position outward the front outer covering portion 14. Accordingly, it is possible to easily pull out the used toner cartridge 1. Furthermore, when the user attaches the new toner cartridge 1 to the container supporting member 7 and pushes the handle in a direction from the front outer covering portion 14 toward the back outer covering portion 15, the toner cartridge is returned to an original position.

In addition, the process unit 10 has a movement prevention mechanism 9, as a mechanism for securing the storage of the container supporting member 7 and the toner cartridge 1. The movement prevention mechanism 9 has a hook member 9*a* and a locking member 9*b*. The front wall portion 12 connected to the bottom wall portion 22 of the container supporting member 7 is formed with the hook member 9*a*, and the housing front portion 16 is formed with the locking member 9*b*. The hook member 9*a* and the locking member 9*b* are provided so that, in a state where the toner cartridge 1 is fixed to the container supporting member 7 and the container supporting member 7 is completely stored, the hook member 9*a* is locked on the locking member 9*b*. Thereby, it is possible to securely maintain the stored state of the toner cartridge 1 fixed to the container supporting member 7. Note that, a configuration of the hook member 9*a* and the locking member 9*b* is not limited to the above, and the hook member 9*a* may be provided in the housing front portion 16 and the locking member 9*b* may be provided in the front wall portion 12.

Furthermore, as shown in FIG. 1, at a position corresponding to the movement prevention mechanism 9, the process unit has a detecting section 19. This detecting section 19 detects a state where the container supporting member 7 is completely stored with the hook member 9*a* locked on the locking member 9*b*, that is, a state where the movement prevention mechanism 9 prevents the container supporting member 7 from moving forward (in the front direction). The detecting section 19 includes a locking sensor 19*a* provided on the locking member 9*b* and a sensing portion 19*b* provided on the hook member 9*a*. The sensing portion 19*b* is disposed at a position at which it acts on the locking sensor 19*a* in the state where the hook member is locked on the locking member 9*b*.

Further, the driving force transmission mechanism 65 is provided at a position facing the toner cartridge 1 in the housing back portion 17. The driving force transmission mechanism 65 transmits a rotary driving force to the toner container 2 of the toner cartridge 1, and includes the main body-side coupling portion 11, the rotation shaft 24, a pressure spring 25, and a gear 27. The rotation shaft 24 serves as a shaft for rotation of the toner container 2, and penetrates the housing back portion 17. A bearing portion (not shown) is provided at a position of the housing back portion 17 in the rotation shaft 24 to allow the rotation shaft 24 to rotate freely.

The main body-side coupling portion 11 is formed into a substantially disc shape, and is fixed to the rotation shaft 24 so as to be capable of being rotated about its axis together with the rotation shaft 24. Formed on a surface in contact with the toner container 2 in the main body-side coupling portion 11 is a cross-like fitting recessed portion into which the container-side coupling portion 6 of the toner container 2 can be fitted. The pressure spring 25 made of a coil spring is disposed between the housing back portion 17 and the main body-side coupling portion 11, and applies a spring force in a direction where the main body-side coupling portion 11 is separated from the housing back portion 17, without inhibiting the rotation of the rotation shaft 24 and the main body-side coupling portion 11. The gear 27 is fixed to an end at an opposite side to the main body-side coupling portion 11 in the rotation shaft 24. A driving force for causing the toner container 2 to rotate is transferred from a driving source of the image forming apparatus 100 to the gear 27.

The toner hopper 13 included in the process unit 10 is a container for reserving toner replenished from the toner cartridge 1 and supplies toner to the developing section 47, depending on the toner consumption in the developing section 47. The developing section 47 supplies toner to the surface of the photoreceptor drum 44 included in the image forming apparatus 100 and visualizes an electrostatic latent image formed on the surface of the photoreceptor drum 44 to form a toner image.

Figure 4:
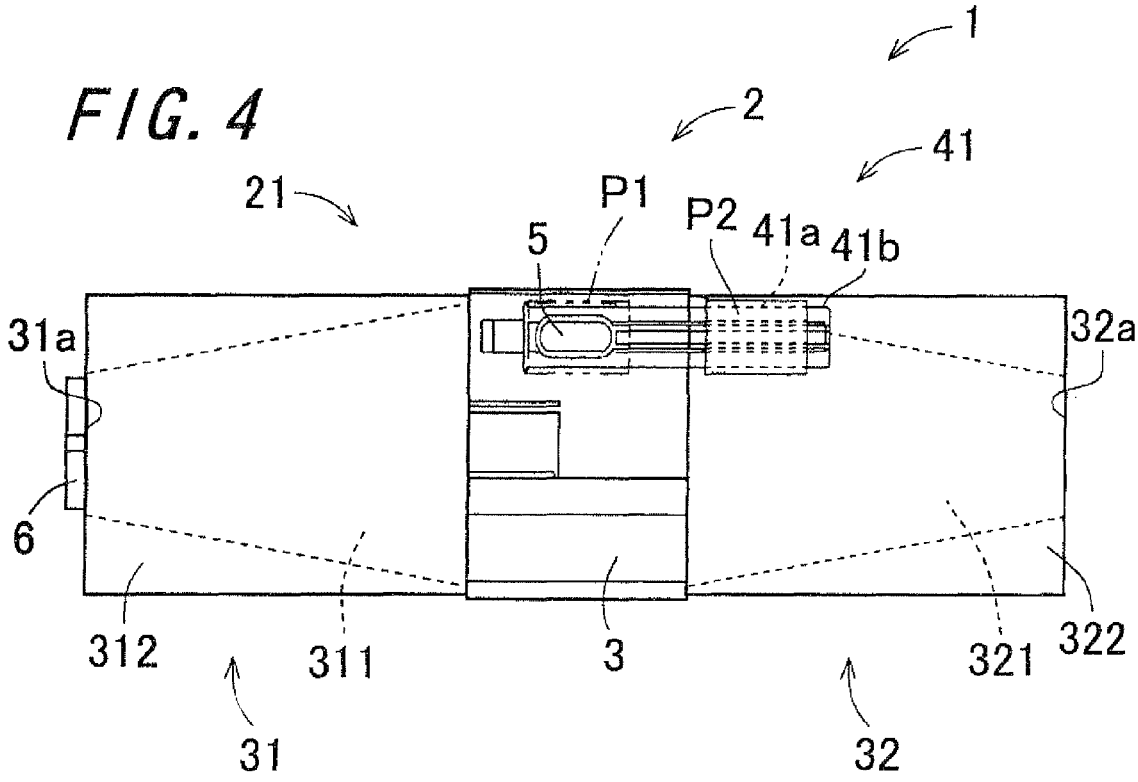
FIG. 4 is a view showing the structure of a toner cartridge according to a first embodiment of the invention.
Figure 5:
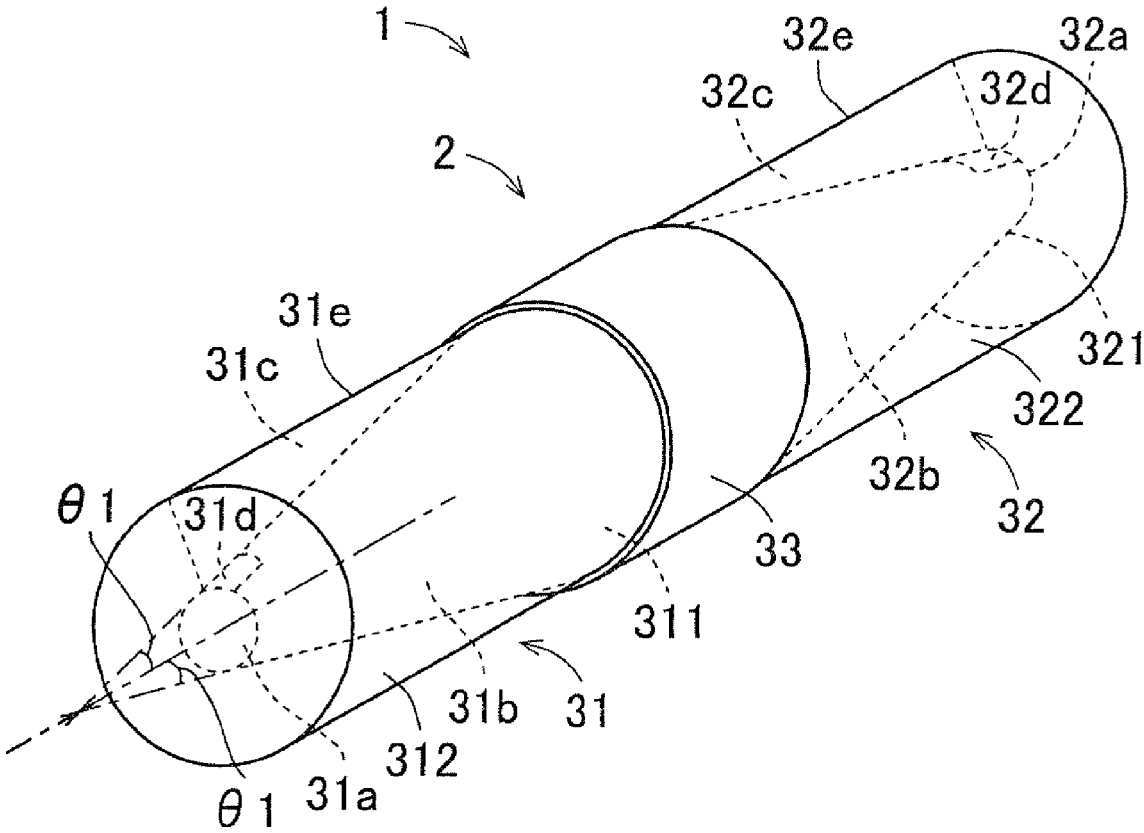
FIG. 5 is a perspective view showing the construction of the toner cartridge.
Figure 6:
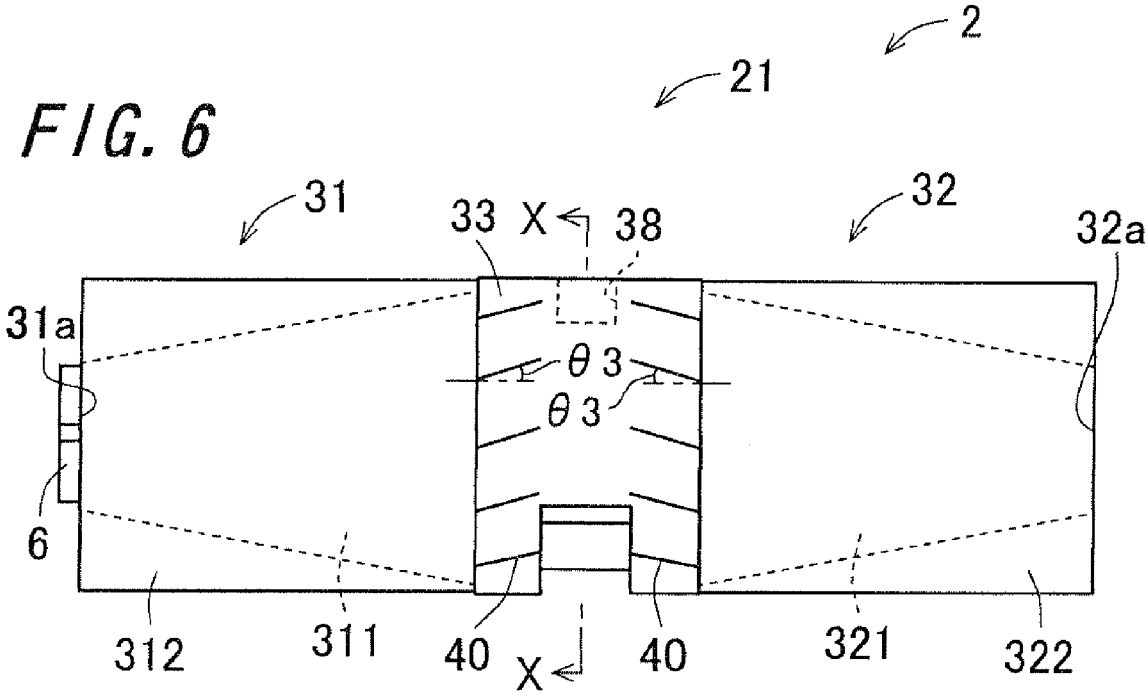
FIG. 6 is a view showing the structure of a toner container.

Next, the toner cartridge included in the process unit 10 will be described. FIG. 4 is a view showing the structure of the toner cartridge 1 according to a first embodiment of the invention. In addition, FIG. 5 is a perspective view showing the structure of the toner cartridge 2. Further, FIG. 6 is a view showing the structure of the toner container 2. The toner cartridge 1 comprises the toner container 2 and the toner container supporting member 3.

The toner container 2 comprises a toner container section 21 which contains toner and has the shape of a bottomed cylinder; and a toner discharging port 38 to discharge toner in the toner container section 21. And the toner container supporting member 3 surrounds a whole circumference of the outer surface of a part of the toner container 2 including the toner discharging port 38 and supports the toner container 2 rotatably. More specifically, the toner container supporting member 3 supports the toner container 2 rotatably about its axis, with the axis of the toner container 2 as a rotation shaft direction. Furthermore, the toner in the toner container section 21 is discharged to outside the toner container 2 by rotation thereof.

The toner container section 21 comprises a first container portion 31 and a second container portion 32, which are filled with the replenished toner; a third container portion 33 in which the toner discharging port 38 is formed; and a container-side coupling portion 6. Furthermore, the toner container section 21 is so continuously structured that the third container portion 33 is disposed in a central portion thereof and at both ends thereof the first container portion 31 and the second container portion 32 are coupled. In the toner container section 2S, one end of the third container portion 33 in the axial direction and an opening end of the first container portion 31 are coupled, and the other end of the third container portion 33 in an axial direction and an opening end of the second container portion 32 are coupled. In addition, each axis of the first container portion 31, the second container portion 32 and the third container portion 33 shares the same axis, i.e. coaxial. Moreover, the container-side coupling portion 6 is a portion to receive a rotary driving force transmitted from the image forming apparatus 100 via the previously described main body-side coupling portion 11, and is disposed at a tip portion 31*a* of the first container portion 31.

The first container portion 31 has the cylindrical outer wall 31*e*, and a partition 31*b* of a truncated cone shape provided thereinside. The inner diameter of the partition 31*b* is decreased as approaching the tip portion 31*a* in the axial direction, that is, with increasing distance from the toner discharging port 38 provided at the third container portion 33. Also, the first container portion 31 includes the inner chamber 311 formed by being surrounded by the partition 31*b*; and the outer chamber 312 formed by being surrounded by the outer wall 31*e* and an outer surface of the partition 31*b*. In this case, the partition 31*b* is formed so that an angle θ1 between a line along the wall surface and the axis is between 15 and 20 degrees.

In addition, the partition 31*b* has a communication port 31*d* at the tip portion 31*a* thereof, that is, an opening through which toner is replenished from the outer chamber 312 to the inner chamber 311. Furthermore, between the outer wall 31*e* and the partition 31*b*, adjacently to the communication port 31*d*, a toner scooping member 31*c* with a triangular plate shape is provided. The toner scooping member 31*c* scoops toner in the outer chamber 312 by rotation of the toner container 2 and guides it to the communication port 31*d*. In addition, the outer wall 31*e* and the partition 31*b* are formed with smooth surfaces without a projection.

The second container portion 32, as well as the first container portion 31, has the cylindrical outer wall 32*e*, and a partition 32*b* of a truncated cone shape provided thereinside.

The inner diameter of the partition 32*b* is decreased as approaching the tip portion 32*b* in the axial direction, that is, with increasing distance from the toner discharging port 38. Furthermore, the second container portion 32 includes the inner chamber 321 formed by being surrounded by the partition 32*b*; and the outer chamber 322 formed by being surrounded by the outer wall 32*e* and the outer surface of the partition 32*b*. In this case, the partition 32*b* is formed so that an angle θ1 between a line along the wall surface and the axis is between becomes 15 and 20 degrees.

In addition, the partition 32*b* has a communication port 32*d* at the tip portion 32*a* thereof, that is, an opening through which toner is replenished from the outer chamber 322 to the inner chamber 321. Furthermore, between the outer wall 32*e* and the partition 32*b*, adjacently to the communication port 32*d*, a toner scooping member 32*c* with a triangular plate shape is provided. The toner scooping member 32*c* scoops toner in the outer chamber 322 by rotation of the toner container 2 and guides it to the communication port 32*d*. Additionally, in the second container portion 32, the outer wall 32*e* and the partition 32*b* are also formed with smooth surfaces without a projection.

Figure 7:
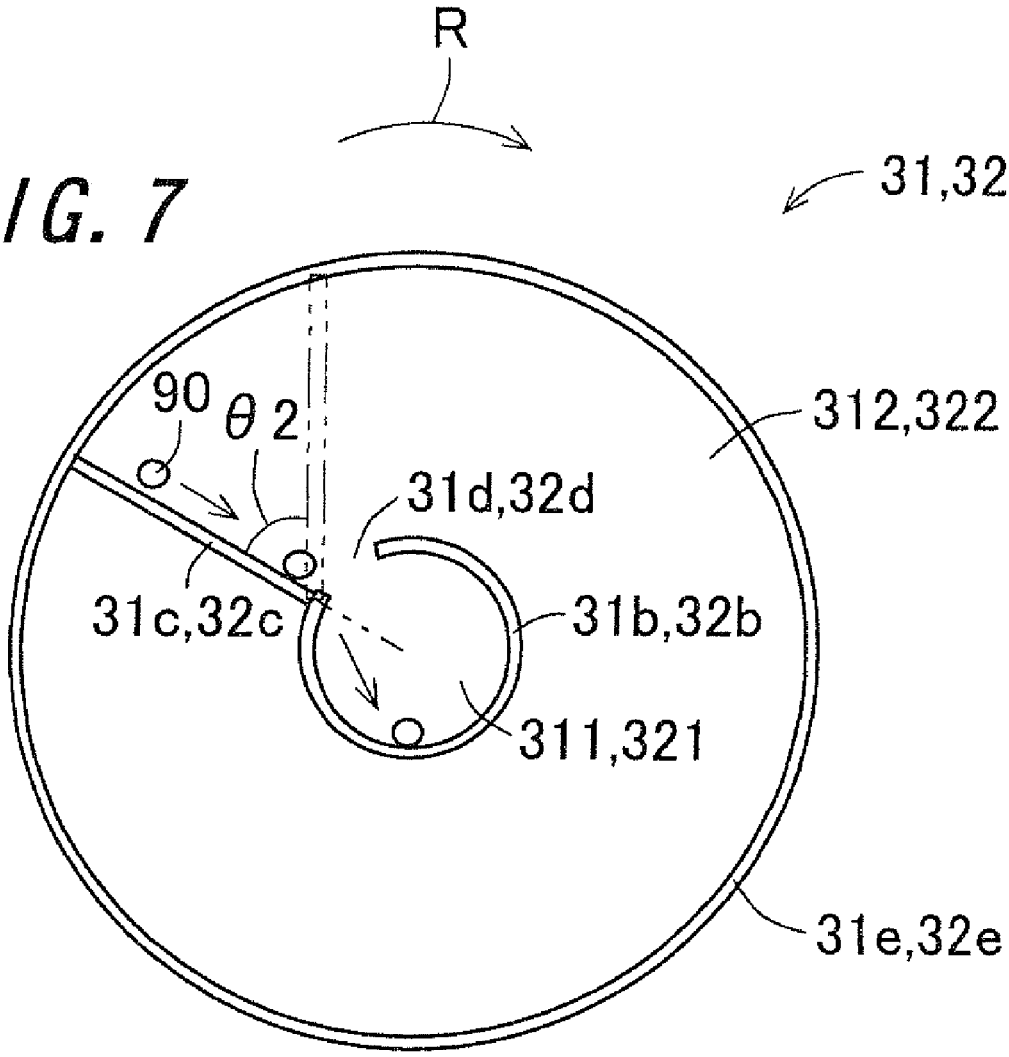
FIG. 7 is a view showing that toner contained in a toner container section is conveyed from an outer chamber toward an inner chamber.
Figure 8:
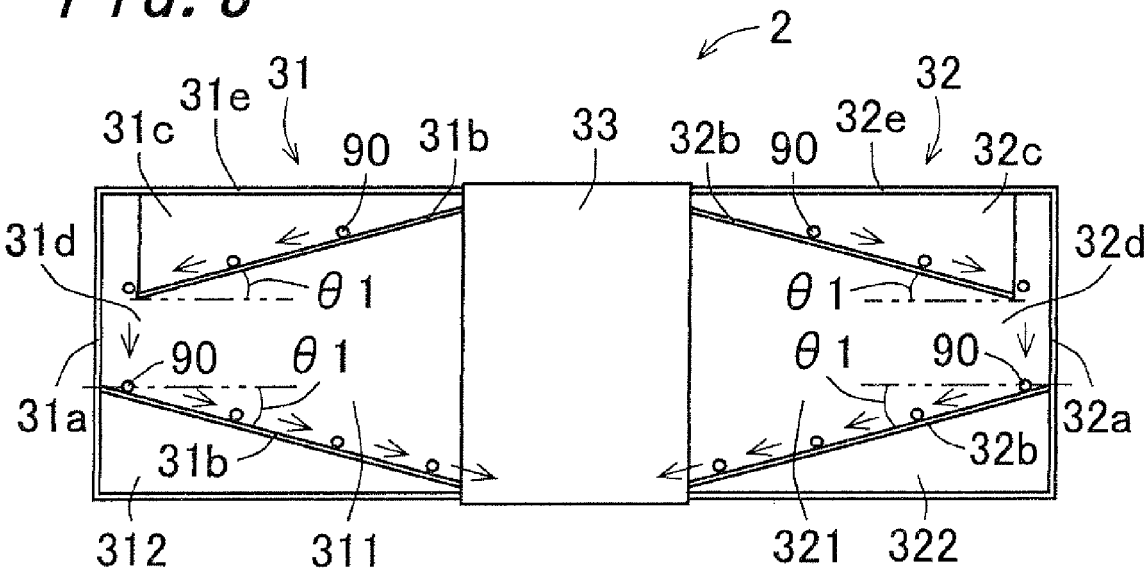
FIG. 8 is a view showing that toner contained in a first and a second container sections is conveyed toward a third container section.

Now, it will be described how the toner contained in the first container portion 31 and the second container portion 32 is conveyed by rotating the toner container 2. FIG. 7 is a view showing that toner contained in the toner container portion is conveyed from the outer chamber to the inner chamber. FIG. 7 is a cross-sectional view taken along a plane perpendicular to the axis, in a vicinity of the communication ports 31*d* and 32*d*. Further, FIG. 8 is a view showing that toner contained in the first container portion and the second container portion is conveyed toward the third container portion. FIG. 8 is a cross-sectional view taken along surface in parallel to the axis.

Toner 90 contained in the outer chambers 312 and 322 of the first and the second container portions 31 and 32 is scooped with the toner scooping members 31*c* and 32*c* by a rotation of the toner container 2 about the axis (rotation direction R) and then slide down the surfaces of the toner scooping members 31*c* and 32*c* toward the outer surfaces of the partitions 31*b* and 32*b*. In this case, the toner scooping members 31*c* and 32*c* are, as shown in FIG. 7, formed as such that an angle θ2, formed by a straight line connecting the center of the toner container 2 with the opening ends of the communication ports 31*d* and 32*d* with respect to opening sides of the communication ports 31*d* and 32*d*, is within a predetermined range (0 to 45 degrees). Thereby, the toner 90 scooped by the toner scooping members 31*c* and 32*c* smoothly slides down toward the communication ports 31*d* and 32*d*.

Then, the toner 90 that has reached the outer surfaces of the partitions 31*b* and 32*b* slides down along the outer surfaces of the partitions 31*b* and 32*b* inclined at the angle θ1, and falls into the inner chambers 311 and 322 through the communication ports 32*d* and 32*d*.

The toner 90 that has fallen into the inner chambers 311 and 322 through the communication ports 31*d* and 32*d* is conveyed toward a third container portion 33 in which the toner discharging port 38 is formed, in such a way that the toner slides down along the inner surfaces of the partitions 31*b* and 32*b* inclined at the angle θ1.

As described above, without providing the inner surface of the toner container 2 with a projection for conveying toner, toner contained in the first and the second container portions 31 and 32 is conveyed toward a third container portion 33 in which the toner discharging port 38 is formed in such a way that the toner slides down by its own weight. When the projection for conveying toner in the toner container is formed, the toner is deposited in a peripheral of the projection portion and remains in the toner container. On the other hand, in the toner container 2 of the invention, the quantity of toner that remains in the toner container section 21, without being discharged therefrom can be reduced, since the outer walls and the partitions with which the toner contacts in the toner container section 21 prevent toner from depositing and, thereby, toner conveyed toward the toner discharging port 38.

Further, since the toner scooping members 31*c* and 32*c* are inclined at the predetermined angle θ2 and the partitions 31*b* and 32*b* are inclined at the predetermined angle θ1, the toner in the toner container section 21 smoothly flows in such a way that the toner slides down on the surfaces of the toner scooping members 31*c* and 32*c*; and the partitions 31*b* and 32*b*. As a result, collisions and friction between toners can be reduced, and embedding of a toner external additive in a binder resin constituting core particles can be prevented. Accordingly, an effect to be able to keep a fluidity of a toner for a long period of time can be obtained.

Figure 9:
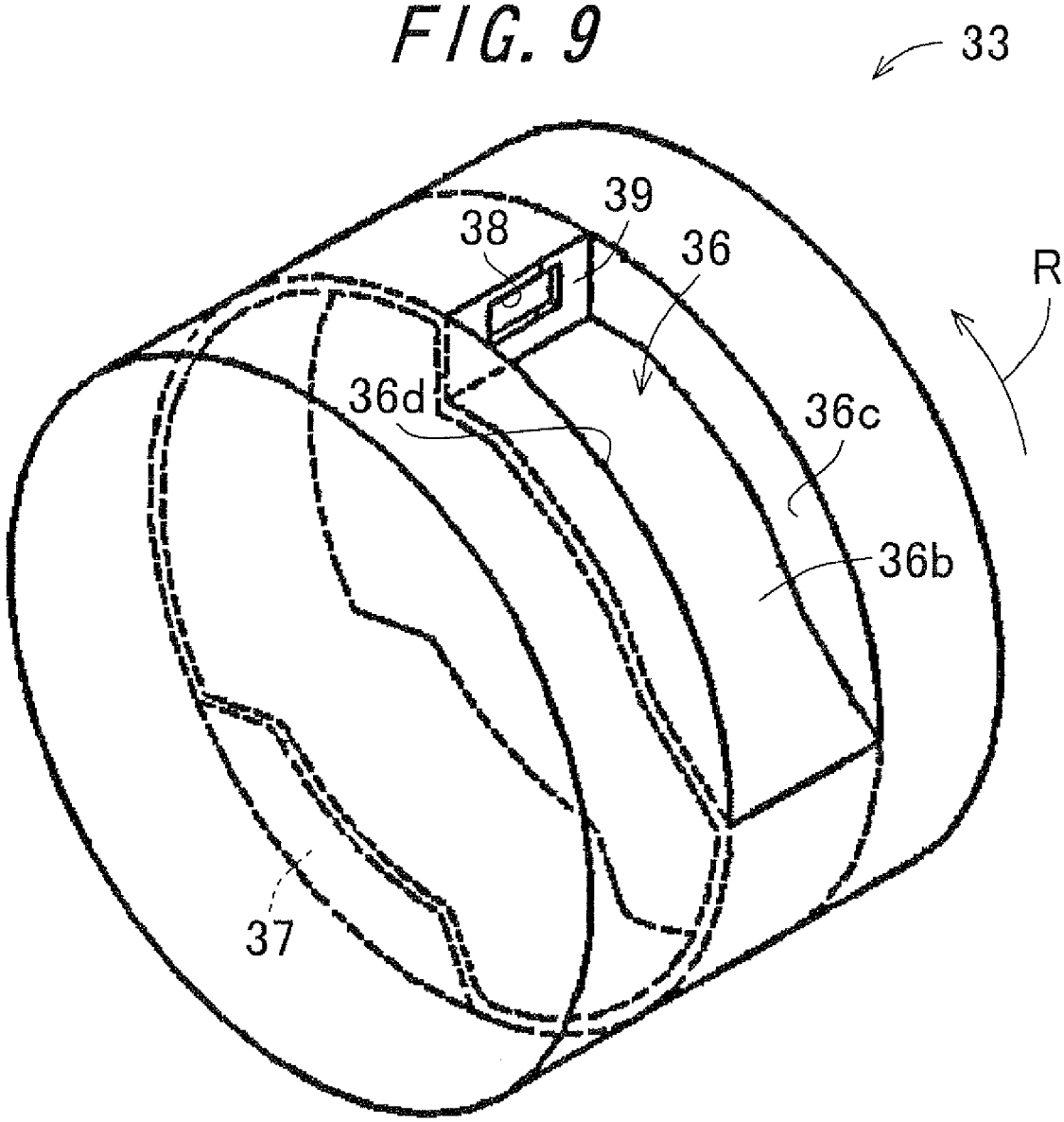
FIG. 9 is a perspective view showing the structure of the third container section.
Figure 10:
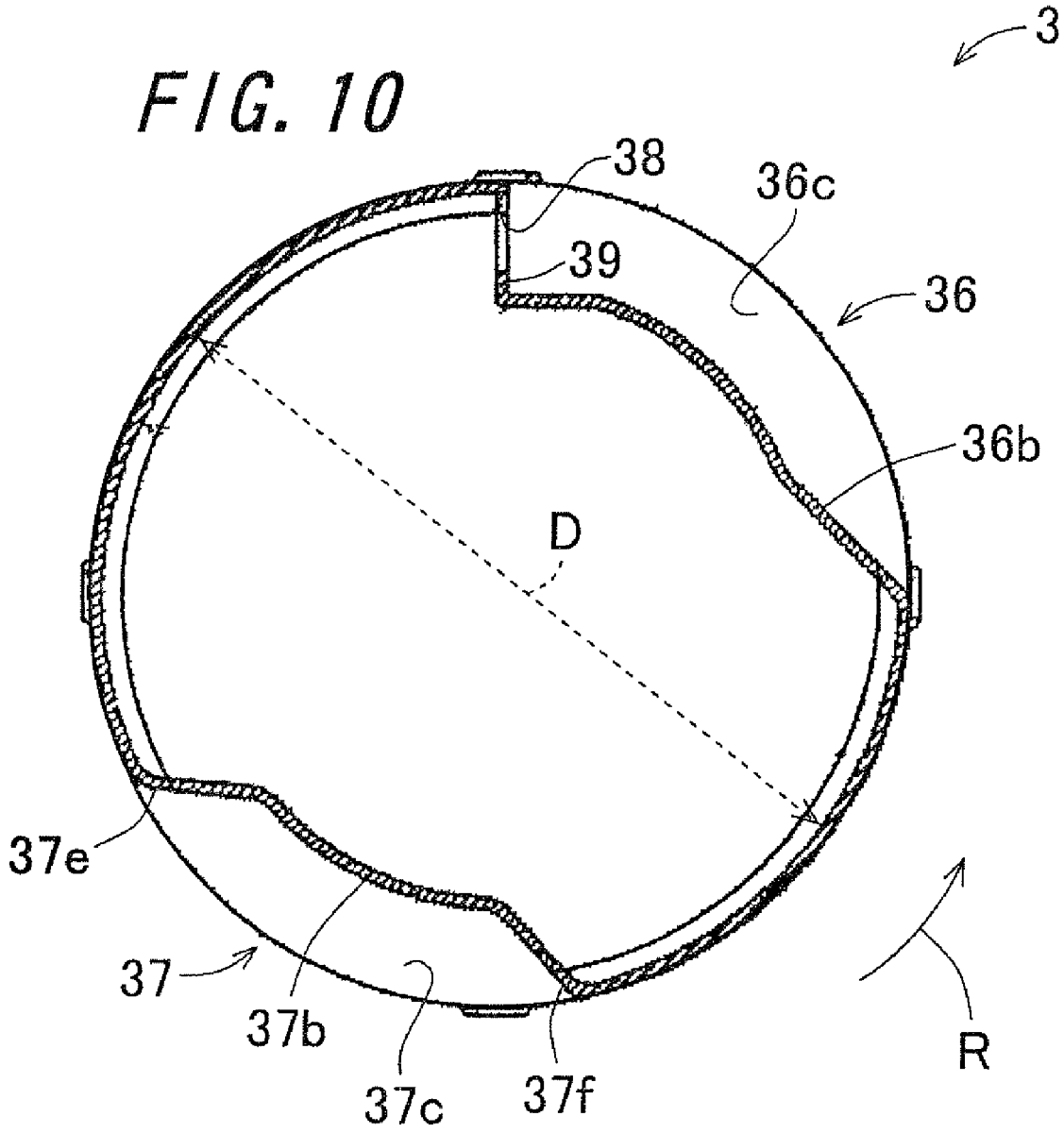
FIG. 10 is a cross-sectional view taken along line X-X of FIG. 6.

Now, the third container portion 33 arranged, in the toner container section 21, between the first container portion 31 and the second container portion 32 will be described. FIG. 9 is a prospective view showing the structure of the third container portion 33. Further, FIG. 10 is a cross-sectional view taken along line X-X of FIG. 6. The third container portion 33 is formed substantially into a cylindrical shape. In order to provide communication between the inside and the outside of the third container portion 33, the toner discharging port 38 is formed therein. This third container portion 33 is rotatably supported by the toner container supporting member 3 around its axis, in the state where a part of a circumference surface of the third container portion 33 including the toner discharging port 38 is entirely surrounded by the toner container supporting member 3.

The third container portion 33 has, in axially middle position about its outer periphery, a first concavity 36 and a second concavity 37 which are concavities which are sunk radially-inwardly. In addition, the third container has the toner discharging port 38 formed in the first concavity 36 for discharging the toner. An inner diameter D of the third container portion 33 excluding the first concavity 36 and the second concavity 37 is formed larger than an inner diameter of the first container portion 31 and the second container portion 32.

The first concavity 36 is so formed as to extend along the rotation direction R, with its axial dimension is made smaller than its dimension in the rotation direction R. The first concavity 36 includes an end wall portion 39 that crosses a downstream side end in the rotation direction R. The toner discharging port 38 is formed in a part of the end wall portion 39 on a downstream side in a rotation direction of the first concavity 36. The second concavity 37 is formed extending in a rotation direction R, and further a dimension in the axial direction thereof is formed small compared with a dimension of the rotation direction R; and the second concavity 37 is provided spacing in a circumference direction between the first concavity 36 and the third container portion 33.

The first concavity 36, more specifically, further includes a bottom wall portion 36*b*, a first side wall portion 36*c* and a second side wall portion 36*d*. The bottom wall portion 36*b* of the first concavity 36 extends in the rotation direction R. Its downstream side end in the rotation direction R is in communication with an inner portion in the radial direction of the end wall portion 36*a*, its upstream side end in the rotation direction R is in smooth communication with an outer circumferential portion of the third container portion 33 excluding the first concavity 36 and the second concavity 37, between the first concavity 36 and the second concavity 37. The central portion in the rotation direction R between the downstream side end in the rotation direction R and the upstream side end in the rotation direction R of the bottom wall portion 36*b* of the first concavity 36 is disposed inward in the radial direction from the third container portion 33 excluding the first concavity 36 and the second concavity 37, and formed substantially into a partially cylindrical shape having the axis of the third container portion 33 as its axis. The radius of curvature of the outer circumferential portion of the central portion in the rotation direction R of the bottom wall portion 36*b* of the first concavity 36 can be arbitrarily set.

The first side wall portion 36*c* of the first concavity 36 is disposed in the one end side in the axial direction of the first concavity 36, and extends in the rotation direction R. The downstream side end in the rotation direction R of the first side wall portion 36*c* is in communication with the one end in the axial direction of the end wall portion 39. The radially inner portion of the first side wall portion 36*c* is in communication with the one end of the bottom wall portion 36*b* and its radially outer portion is in communication with the outer circumferential portion of one end in the radial direction of the third container portion 33 excluding the first concavity 36 and the second concavity 37. The second side wall portion 36*d* of the first concavity 36 is disposed in the other end side in the axial direction of the first concavity 36, and extends in the rotation direction R. The downstream side end of the second side wall portion 36*d* in the rotation direction R is in communication with the other end in the radial direction of the end wall portion 39. The radially inner portion of the second side wall portion 36*d* is in communication with the other end of the bottom wall portion 36*b* and its radially outer portion is in communication with the outer circumferential portion of the other end in the radial direction of the third container portion 33 excluding the first concavity 36 and the second concavity 37. The first side wall portion 36*c* and the second side wall portion 36*d* of the first concavity 36 are provided upright from the bottom wall portion 36*b* outwardly in the radial direction, and the bottom wall portion 36*b* is substantially perpendicular to the first side wall portion 36*c*, and the bottom wall portion 36*b* is substantially perpendicular to the second side wall portion 36*d*.

The toner discharging port 38 is formed in the axially middle position of the end wall portion 39 of the first concavity 36 so as to be located outward in the radial direction. Moreover, the toner discharging port 38 is shaped as a rectangular opening whose longitudinal direction is aligned with the axial direction. Therefore, in the end wall portion 39 of the first concavity 36, the toner discharging port 38 is so formed as to open radially outward as compared to the downstream side end in the rotation direction R of the bottom wall portion 36*b* of the first concavity 36, to open in the other axial end-ward position as compared to the downstream side end in the rotation direction R of the first side wall portion 36*c*, and to open in the one axial end-ward position as compared to the downstream side end in the rotation direction R of the second side wall portion 36*d*. More specifically, the toner discharging port 38 has its radially outer surface made in smooth communication with the inner circumferential surface of the third container portion 33 excluding the first concavity 36 and the second concavity 37 on the downstream side in the rotation direction R of the first concavity 36.

The second concavity 37, more specifically, further includes a bottom wall portion 37*b*, a first side wall portion 37*c* and a second side wall portion 37*d*. The bottom wall portion 37*b* of the second concavity 37 extends in the rotation direction R. The upstream side end of the second concavity 37 in the rotation direction R and its downstream side end in the rotation direction R are in smooth communication with an outer circumferential portion of the third container portion 33 excluding the first concavity 36 and the second concavity 37, between the first concavity 36 and the second concavity 37. The central portion in the rotation direction R between the downstream side end in the rotation direction R and the upstream side end in the rotation direction R of the bottom wall portion 37*b* of the second concavity 37 is disposed inward in the radial direction from the third container portion 33 excluding the first concavity 36 and the second concavity 37, and formed substantially into a partially cylindrical shape having the axis of the third container portion 33 as its axis. The radius of curvature of the outer circumferential portion of the central portion in the rotation direction R of the bottom wall portion 37*b* of the first concavity 37 can be arbitrarily set.

The first side wall portion 37*c* of the second concavity 37 is disposed in the one end side in the axial direction of the second concavity 37, and extends in the rotation direction R. The radially inner portion of the first side wall portion 37*c* is in communication with the one end in the axial direction of the bottom wall portion 37*b* and its radially outer portion is in communication with the outer circumferential portion of one end in the radial direction of the third container portion 33 excluding the first concavity 36 and the second concavity 37. The second side wall portion 37*d* of the second concavity 37 is disposed in the other end side in the axial direction of the second concavity 37. The radially inner portion of the bottom wall portion 37*b* is in communication with the other end of the bottom wall portion 37*b* and its radially outer portion is in communication with the outer circumferential portion of the other end in the radial direction of the third container portion 33 excluding the first concavity 36 and the second concavity 37. The first side wall portion 37*c* and the second side wall portion 37*d* of the second concavity 37 are provided upright from the bottom wall portion 37*b* outwardly in the radial direction, and the bottom wall portion 37*b* is perpendicular to the first side wall portion 37*c*, and the bottom wall portion 37*b* is substantially perpendicular to the second side wall portion 37*d*.

As shown in FIG. 6, a plurality of toner discharging guide pieces 40 projecting outward in the radial direction are disposed about the circumferential direction in the outer circumferential portion of the one and the other ends in the axial direction of the third container portion 33 excluding the first concavity 36 and the second concavity 37. The toner discharging guide pieces 40 are evenly spaced in the circumferential direction. Specifically, the toner discharging guide pieces 40 disposed at one end in the axial direction of the third container portion 33 are gradually inclined in the rotation direction R from the other end in the axial direction to one end in the axial direction. On the other hand, specifically, the toner discharging guide pieces 40 disposed at the other end in the axial direction of the third container portion 33 are gradually inclined in the rotation direction R from the one end in the axial direction to the other end in the axial direction. An angle θ3 which is formed between the longitudinal direction of the toner discharging guide pieces 40 and the width direction of the third container portion 33 is set to, for example, around 30 degrees.

Figure 11:
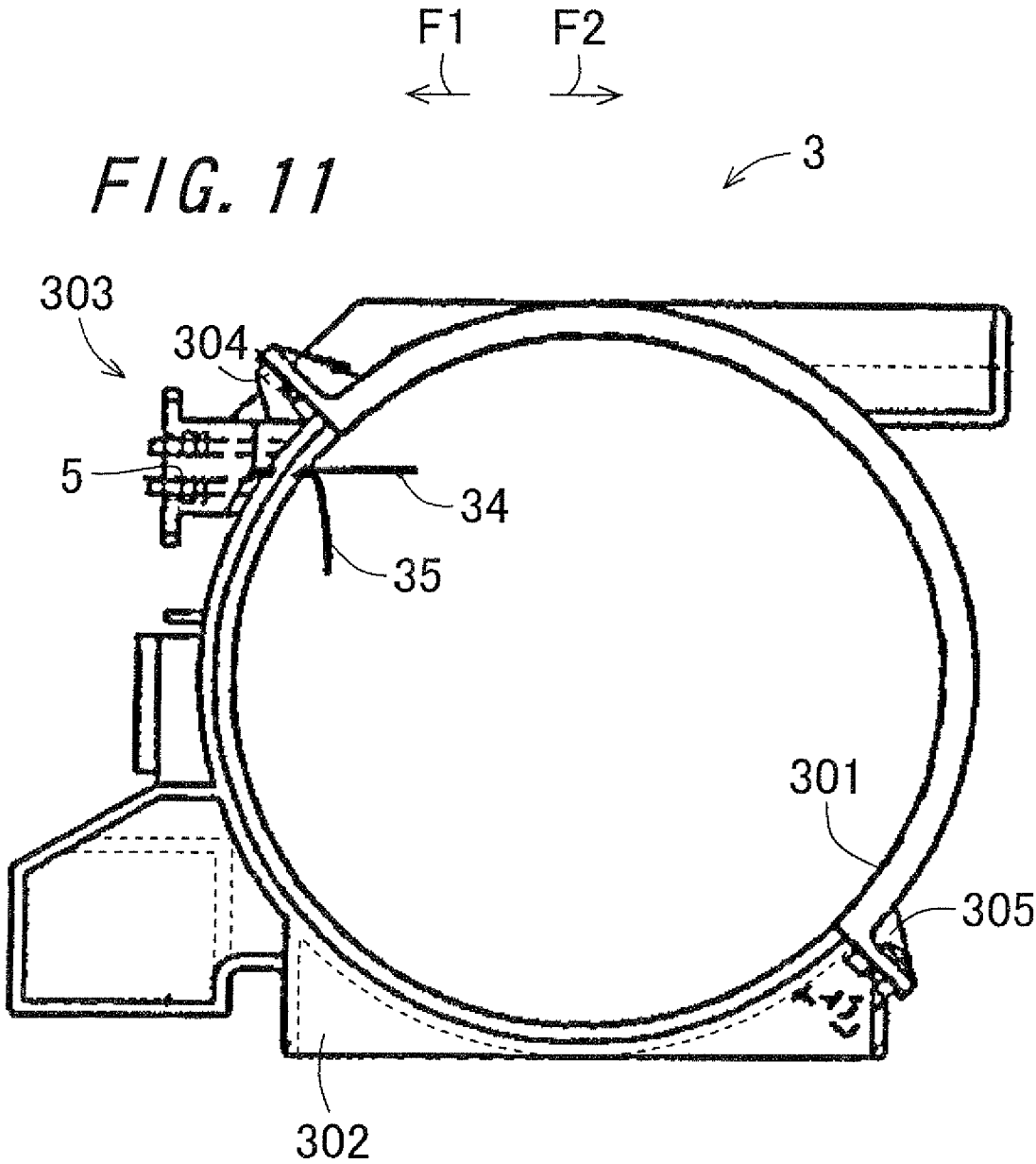
FIG. 11 is a view showing the structure of a toner container supporting member.

FIG. 11 is a view showing the structure of the toner container supporting member 3. The toner container supporting member 3 is formed substantially into a cylindrical shape, and has an inner circumferential portion 301 so as to support portions including at least the third container portion 33 throughout the whole circumference from the outer side in the radial direction. The inner circumferential portion 301 has a cylindrical inner circumferential surface with the axis as the center. The toner container supporting member 3 includes a support stand 302 having at least 3 contact portions on a virtual plane parallel to its axis. The contact portions of the support stand 302 may be formed, for example, into two rectangular flat faces having a direction parallel to the axis as its longitudinal direction. By bringing the contact portions of the support stand 302 into contact with the horizontal plane, the axis L of the inner circumferential portion 301 of the toner container supporting member 3 can be disposed parallel to the horizontal plane. The length in the axial direction of the toner container supporting member 3 is set to be larger than the length in the axial direction of the third container portion 33.

In the state where the support stand 302 is installed on the horizontal surface, in the toner container supporting member 3, an discharging portion 303 projecting to one direction F1 of a first horizontal direction, that is, one direction of one horizontal direction, is formed in its upper portion. In an intermediate portion in the axial direction of the toner container supporting member 3 in the discharging portion 303, a toner through hole 5 that penetrates along the one direction F1 of the first horizontal direction, and is an elliptic opening extending in a direction parallel to the axis of the toner container supporting member 3 is formed. The inner diameter of the toner through hole 5 in the longitudinal direction is set to equal to or larger than the size of the first concavity 36 of the toner container 2 in the axial direction and the size of the second concavity 37 of the toner container 2 in the axial direction.

As shown in FIG. 4, in the discharging portion 303 of the toner container supporting member 3, a shutter portion 41 is provided for switching the opening of the through hole 5 on the downstream side in the one direction F1 of the first horizontal direction between the open state and the closed state. The shutter portion 41 includes a shutter 41*a* and a shutter guide portion 41*b*. The shutter guide portion 41*b* extends in a second horizontal direction, that is, a horizontal direction perpendicular to the first horizontal direction, and the through hole 5 is opened in the upstream side end in one direction of the second horizontal direction. The shutter 41*a* is supported by the shutter guide portion 41*b* slidably in one direction of the second horizontal direction and in the other direction of the second horizontal direction, which is a direction opposite to the one direction of the second horizontal direction.

The shutter 41*a* can be positioned at a closed position P1 shown by a double-dotted dashed line in FIG. 4 at which the opening of the toner through hole 5 on the downstream side in the one direction F1 of the first horizontal direction is closed. Moreover, the shutter 41 can be positioned at an open position P2 at which the opening of the toner through hole 5 on the downstream side in the one direction of the first horizontal direction F1 is open by sliding along the shutter guide portion 41*b*. The shutter 41*a* is controlled so as not to slide on the downstream side in the other direction of the second horizontal direction from the closed position P1, and controlled so as not to slide from the end on the downstream side in the one direction of the second horizontal direction of the shutter guide portion 41*b* to the one direction of the second horizontal direction. That is to say, the open position P2 is on the downstream side in the one direction of the second horizontal direction from the closed position P1 and on the upstream side in the one direction of the second horizontal direction from the end on the downstream side in the one direction of the second horizontal direction of the shutter guide portion 41*b*. Thus, the shutter 41*a* is positioned at the open position P2 by sliding in the one direction of the second horizontal direction when positioned at the closed position P1, and is positioned at the closed position P1 by sliding in the other direction of the second horizontal direction when positioned at the open position P2.

Now, a shutter displacing section for sliding the shutter 41*a* of the shutter portion 41 is provided in the toner hopper 13 described above. The shutter displacing section displaces the shutter 41*a* disposed at the closed position P1, when the container supporting member 7 containing the toner cartridge 1 is inserted into the main body of an image forming apparatus 100 described later. Then, the shutter displacing section disposes the shutter 41*a* at the open position P2, provided that the toner cartridge 1 is disposed at a predefined position. Furthermore, when the container supporting member 7 containing the toner cartridge 1 is removed from the main body of the image forming apparatus 100, the shutter displacing section displaces the shutter 41 and disposes it at the closed position P1.

In addition, the toner container supporting member 3 has a toner leading-out member 34, that is, a leading-out section, and a sealing sheet 35, that is, a sealing section. The toner leading-out member 34 is made of, for instance, polymer resin such as polyethylene terephthalate (abbreviated as PET), is formed into a sheet having flexibility and elasticity. The fixed end of the toner leading-out member 34 is arranged in the inner circumferential portion of the toner container supporting member 3, specifically, at a portion facing the upstream side end in the one direction of the first horizontal direction of the toner through hole 5 of the toner container supporting member 3. More specifically, the toner leading-out member 34 goes into the first concavity 36 and the second concavity 37 of the toner container 2 rotating in the toner container supporting member 3, scoops the toner that builds up therein and carries the toner out of the toner through hole 5.

The sealing sheet 35 is formed into a sheet having flexibility made of, for instance, polyethylene, and its fixed end is arranged in a portion facing the upstream side end in the one direction of the first horizontal direction of the toner through hole 5 of the toner container supporting member 3. The fixed end of the toner leading-out member 34 is stacked on an upper portion of the fixed end of the sealing sheet 35. More specifically, the sealing sheet 35 is adhered to the toner container supporting member 3 as sealing the toner discharging port 38, in the state where the third container portion 33 of the toner container 2 is supported by the toner container supporting member 3, the toner container 2 has not started its first rotation and the toner discharging port 38 of the toner container 2 is disposed at a position adjacent to the toner through hole 5 of the toner container supporting member 3.

Further, in the toner container supporting member 3, two coupled projection portions 304 projecting outward in a radial direction are formed. In the state where the support stand 302 is installed on the horizontal plane, one coupled projection portions 304 is disposed above the discharging portion 303 and the other coupled projection portion 304 is disposed at a position symmetric to the one of the coupled projection portions 304 with respect to the axis.

Furthermore, the toner container supporting member 3 can be divided into two by a virtual plane that passes through the axis and inclines upward as going to the one direction of the first horizontal direction F1. The each of the supporting member virtually divided is coupled removably with screw members 305. Therefore, when supporting the toner container 2, the toner container supporting member 3 is previously divided, and the divided toner container supporting members 3 support a portion including the first and second concavities 36 and 37 and the toner discharging port 38 of the toner container 2 from the outer side in the radial direction, so that the toner container 2 can be supported throughout the whole circumference thereof, and such assembling work can be easily performed.

FIGS. 12A, 12B, 13A and 13B are views for illustrating the behavior in which the developer in the third container portion 33 of the toner container 2 is led to the toner through hole 5 of the toner container supporting member 3 when the toner container 2 is rotated in the rotation direction R about the rotation axis. In the state where the toner container 2 is supported by the toner container supporting member 3 rotatably about the rotation axis, a first holding space 301*a* is formed, facing the first concavity 36 of the third container portion 33 and the inner circumferential portion 301 of the toner container supporting member 3. The first holding space 301*a* is a space that is substantially closed except the toner discharging port 38, and is disposed on the upstream side in the rotation direction R of the toner discharging port 38, and is in communication with the space in the toner container 2 via the toner discharging port 38. A second holding space 301*b* is formed, facing the second concavity 37 of the third container portion 33 and the inner circumferential portion 301 of the toner container supporting member 3. The second holding space 301*b* is a space that is substantially closed.

When the toner cartridge 1 is attached to the image forming apparatus 100, in the toner cartridge 1, the toner leading-out member is disposed in the first holding space 301*a*, and the toner discharging port 38 of the first concavity 36 is sealed by the sealing sheet 35. When the toner cartridge 1 is attached to the image forming apparatus 100 and the main body-side coupling portion 11 is rotated by transmitting a driving force to the driving force transmission mechanism 65, the toner container 2 engaged with the main body-side coupling portion 11 is rotated, and thereby the sealing sheet 35 is detached.

Figure 12A:
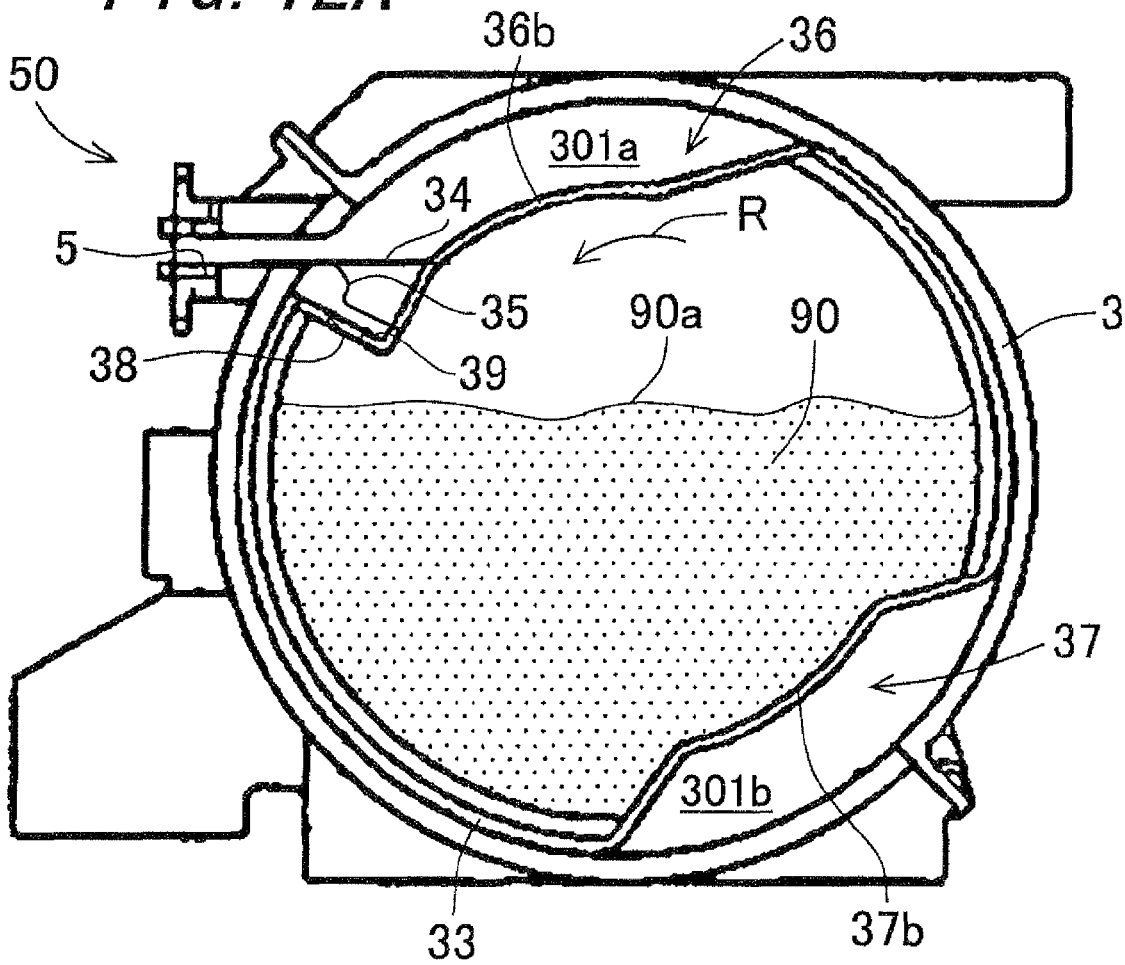
FIGS. 12A, 12B, 13A and 13B are views illustrating the behavior in which the developer in the third container section of the toner container is led to a toner through hole of the toner container supporting member when the toner container is rotated in the rotation direction R about its rotation axis.

Upon the rotation of the toner container 2 in the rotation direction R, the condition is changed from the state shown in FIG. 12A in which the toner discharging port 38 and the first holding space 301*a* are positioned above an upper surface 90*a* of the toner 90 existing within the toner container 2, to the state shown in FIG. 12B in which the toner discharging port 38 and a downstream portion in the rotation direction R of the first holding space 301*a* are positioned below the upper surface 90*a* of the toner 90 existing within the toner container 2. Then, the toner 90 in the toner container 2 flows into the downstream portion in the rotation direction R of the first holding space 301*a* aria the toner discharging port 38, as shown by an arrow G1.

As described above, the toner discharging port 38 is formed in the axially middle position of the end wall portion 39 of the first concavity 36 so as to be located outward in the radial direction. Moreover, the toner discharging port 38 is shaped as a rectangular opening whose longitudinal direction is aligned with the axial direction. Therefore, in the end wall portion 39 of the first concavity 36, the toner discharging port 38 is so formed as to open radially outward as compared to the downstream side end in the rotation direction R of the bottom wall portion 36*b* of the first concavity 36, to open in the other axial end-ward position as compared to the downstream side end in the rotation direction R of the first side wail portion 36*c*, and to open in the one axial end-ward position as compared to the downstream side end in the rotation direction R of the second side wall portion 36*d*.

For example, assume that the toner discharging port 38 is so formed as to open all over the area of the end wall portion 39. In this case, by rotation of the toner container 2 in the rotation direction R, the toner 90 is squeezingly moved along the first concavity 36 of the toner container 2 and the inner circumferential portion 301 of the toner container supporting member 3, so that it may be discharged from the toner discharging port 38 to the first holding space 301*a* while being. Then, by further rotation of the toner container 2 in the rotation direction R, the toner 90 held in the first holding space 301*a* is pressed by the first concavity 36 of the toner container 2 and the inner circumferential portion 301 of the toner container supporting member 3, which may lead to aggregation of the toner. In this embodiment, as described above, the toner discharging port 38 is formed in part of the end wall portion 39 of the first concavity 36, in other words, the opening area of the toner discharging port 38 is formed narrower than the area of the end wall portion 39. This allows, in the vicinity of the toner discharging port 38, the toner to be diffusely discharged to the first holding space 301*a*. Thus, the toner 90 discharged to the second holding space 301*a* can be pulverized into a fine particles, and the aggregation of the toner 90 due to rotation of the toner container 2 as described above can be suppressed.

Furthermore, the radially outer surface of the toner discharging port 38 is in smooth communication with the inner circumferential portion 301 of the third container portion 33 excluding the first concavity 36 and the second concavity 37 on the downstream side in the rotation direction R of the first concavity 36. Thus, even if the toner 90 contained in the toner container 2 becomes very small in quantity, the toner 90 can flow smoothly into the downstream portion in the rotation direction R of the first holding space 301*a* via the toner discharging port 38.

Figure 12B:
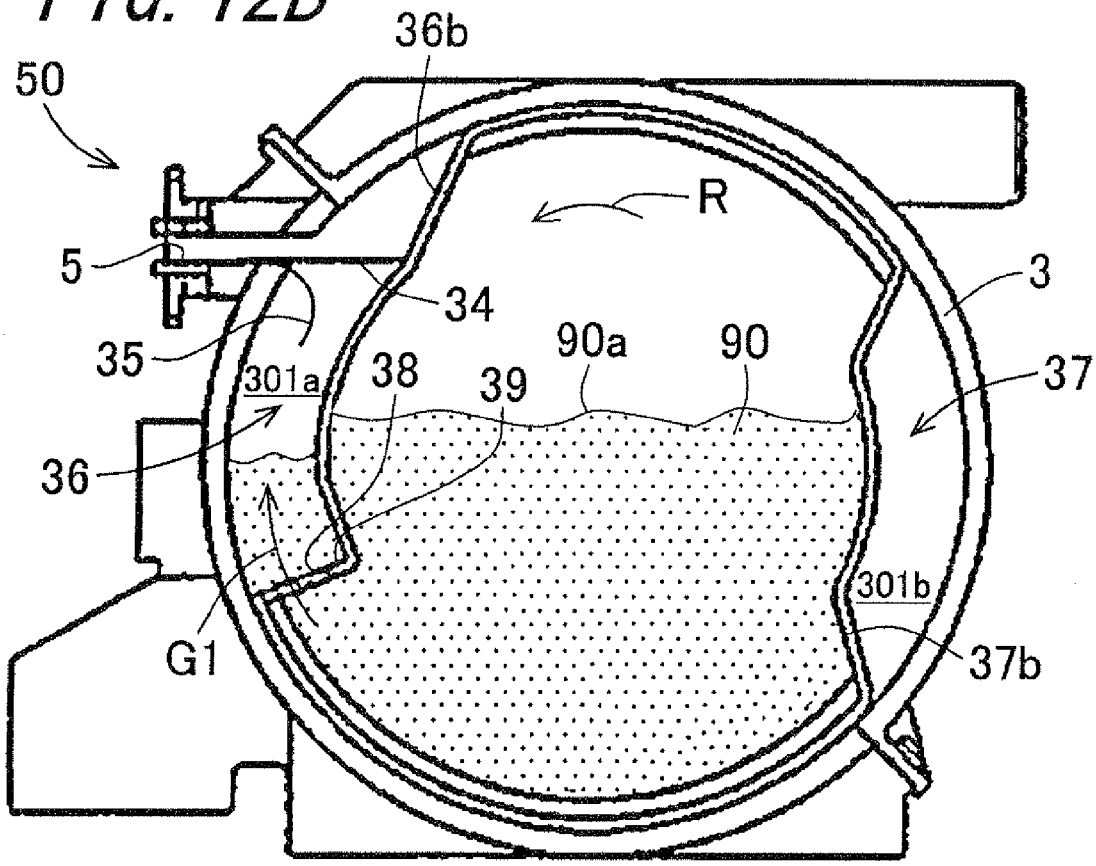
Figure 13A:
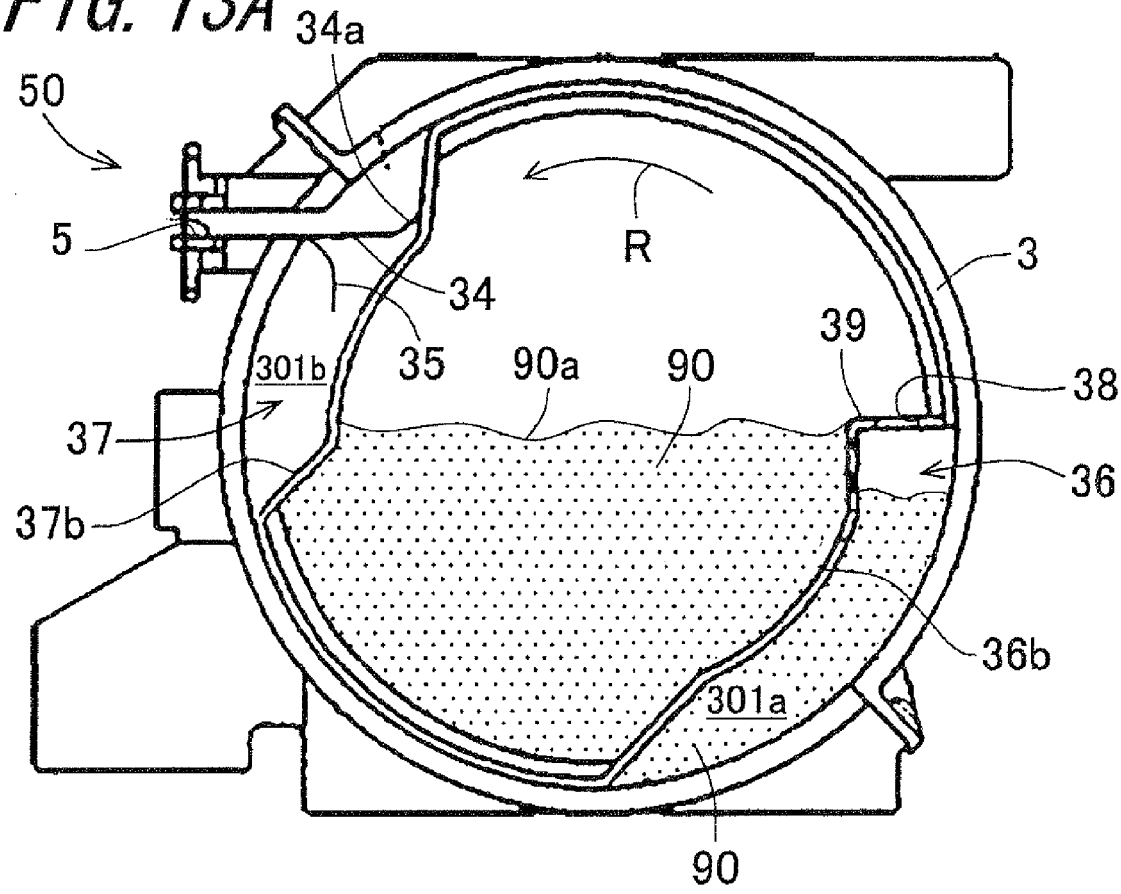

In the state as shown in FIG. 12B, the toner contained in the toner container flows through the toner discharging port 38 into the downstream side part in the rotation direction R of the first holding space 301*a*. Then, upon further rotation of the toner container 2 in the rotation direction R, the condition is changed from the state as shown in FIG. 12B to the state as shown in FIG. 13A in which the toner discharging port 38 is positioned above the upper surface 90*a* of the toner 90 in the toner container 2, and the first holding space 301*a* is positioned below the upper surface 90*a* of the toner 90 in the toner container 2. In the state as shown in FIG. 13A, the predetermined quantity of the toner 90 is held in the first holding space 301*a*.

Figure 13B:
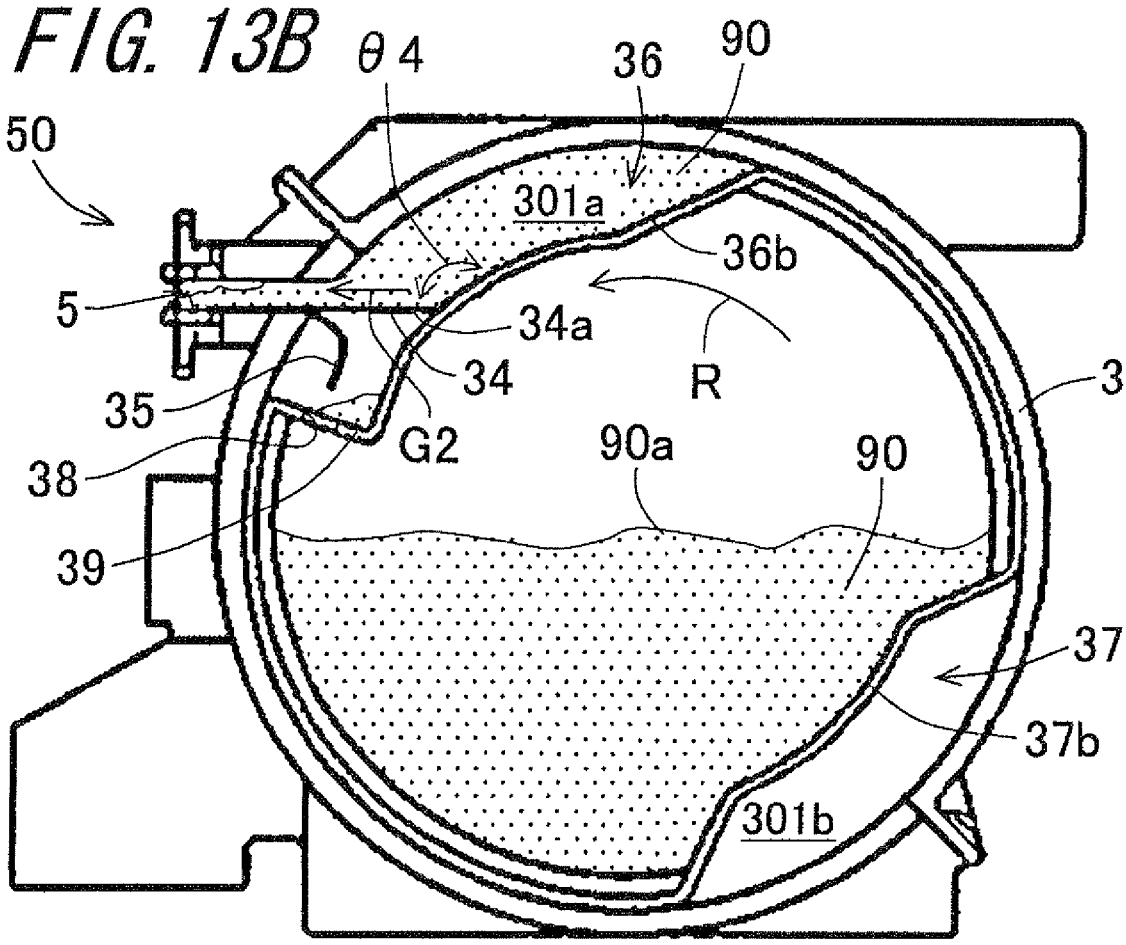

Upon still further rotation of the toner container in the rotation direction R, the condition is changed from the state as shown in FIG. 13A to the state as shown in FIG. 13B in which the free end 34*a* of the toner leading-out member 34 of the toner container supporting member 3 enters the first holding space 301*a*, so that it juts out on the upstream side in the rotation direction R, and abuts resiliently against the outer circumferential portion of the bottom wall portion 36*b* of the first concavity 36 slidingly at an angle θ4 of greater than 90 degrees. At this time, the toner, held in the first holding space 301*a* located in a position on the upstream side in the rotation direction R as compared to the toner leading-out member 34, finds its way toward the toner container supporting member 3 in accompaniment with the rotation of the toner container 2 in the rotation direction R.

As indicated by the arrow G2, the toner leading-out member 34 guides the toner 90 that thus flowed in, in other words, the toner 90 having been discharged from the toner discharging port 38 of the toner container 2, along its upper surface of the toner leading-out member 34, to lead it to the toner through hole 5. The toner leading-out member 34 slides over the outer circumferential portion of the bottom wall portion 36*b* of the first concavity 36 in such a way that the toner is scooped from the outer circumferential portion. Therefore, a substantially whole amount of the toner 90 held in the first holding space 301*a* can be directed to the toner through hole 5. The toner that thus reached the to the toner through hole 5 is then discharged out of the toner cartridge 1. In this way, every time the toner container makes one rotation about the rotation axis in the rotation direction R, the above-mentioned predetermined quantity of the toner 90 is discharged to the outside.

As described previously, in order to reduce the frictional force that hinders the rotation of the toner container 2 about the rotation axis, the inner circumferential portion 301 of the toner container supporting member 3 and the third container portion 33 excluding the first and the second concavities 36 and 37 are designed so as not to abut against each other over the entire circumference in the circumferential direction. Such a structure is not without the potential of the leakage of the toner 90 held in the first holding space 301*a* as described above. Hence, as described previously, the toner discharging guide pieces 40 are disposed about the outer circumferential portion of each end of one and the other axial ends of the third container portion 33 excluding the first concavity 36 and the second concavity 37. The toner discharging guide pieces 40 disposed at one axial end of the third container portion 33 are gradually inclined in the rotation direction R from the other axial end side to one axial end side. On the other hand, the toner discharging guide pieces 40 disposed at one axial end of the third container portion 33 are gradually inclined in the rotation direction R from one axial end side to the other axial end side. In the event that the toner 90 held in the first holding space 301*a* leaks therefrom toward one and the other sides as viewed in the direction of the rotation axis, during the rotation of the toner container 2 in the rotation direction R, each of the toner discharging guide pieces 40 can gather the toner around the axially middle position of the third container portion 33 and the toner container supporting member 3.

Furthermore, as described above, the second holding space 301*b* is additionally provided. In the event that the toner 90 held in the first holding space 301*a* leaks from its upstream in the rotation direction R, the toner 90 leaked out as well as the toner 90 gathered around axially middle portion by each of the toner discharging guide pieces 40, is held in the second holding space 301*b*. Upon the rotation of the toner container 2 in the rotation direction R, as shown in FIG. 13A, the free end 34*a* of the toner leading-out member 34 of the toner container supporting member 3 enters the second holding space 301*b*, so that it juts out on the upstream side on the rotation direction R, and abuts resiliently against the outer circumferential portion of the bottom wall portion 37*b* of the second concavity 37 slidingly at an angle of greater than 90 degrees. At this time, the toner, held in the second holding space 301*b* located in the upstream side in the rotation direction R as compared to the toner leading-out member 34, find its way toward the toner container supporting member 3 in accompaniment with the rotation of the toner container 2 in the rotation direction R. Then, the toner is directed to the toner through hole 5 to be discharged out of the toner cartridge 1. In this way, in the event of the toner leaking from the first holding space 301*a*, every time the toner container 2 makes one rotation about the rotation axis in the rotation direction R, the leaked toner 90 can be held in the second holding space 301*b*. As a result, the above mentioned predetermined quantity of toner can be discharged as reliably as possible.

Next, other embodiments of the toner cartridge according to the invention will be described. The toner cartridge 70 of a second embodiment, the toner cartridge 80 of a third embodiment, the toner cartridge 180 of a fourth embodiment, and the toner cartridge 280 of a fifth embodiment described below are attached to the image forming apparatus 100 described later in the same way as the toner cartridge 1 previously described. Thus, on the toner cartridges 70, 80, 180, and 280, basic operations when attached to the image forming apparatus 100 are the same as those on the toner cartridge 1. Accordingly, in the following description, description of the basic operations is omitted, and only characteristic matters are described.

Figure 14:
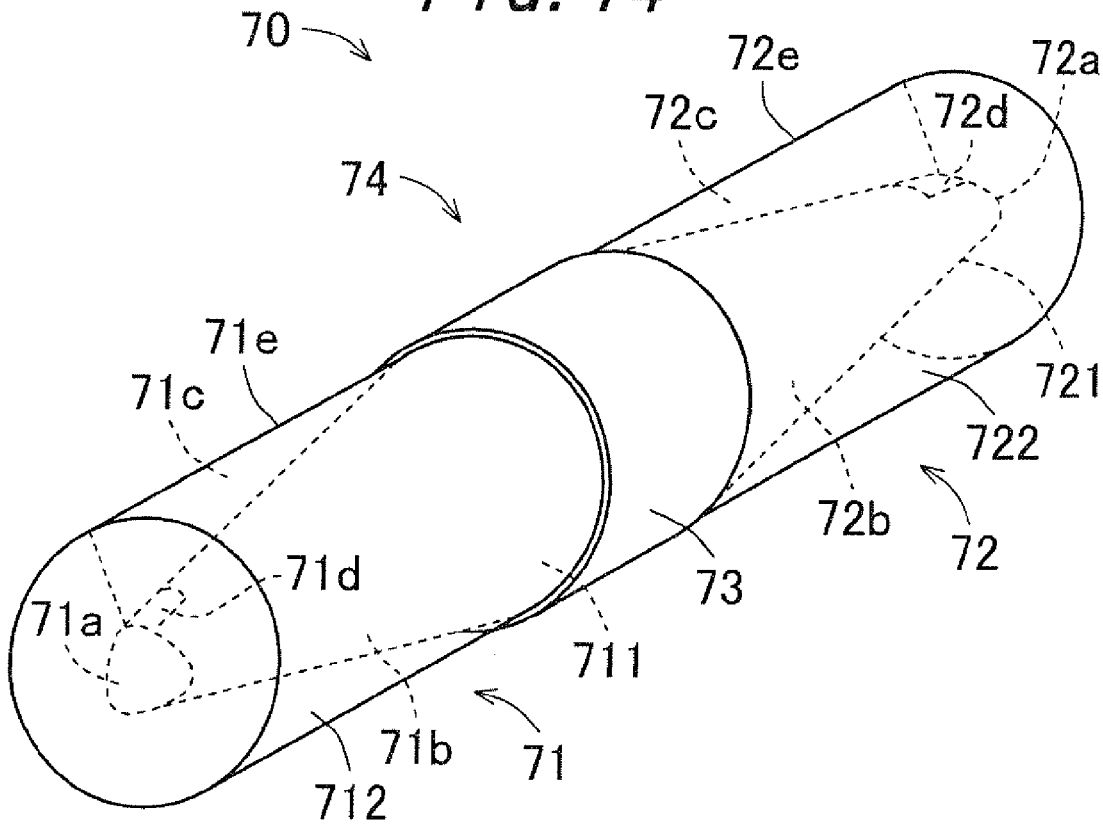
FIG. 14 is a perspective view showing the structure of a toner cartridge according to a second embodiment of the invention.

FIG. 14 is a perspective view showing the structure of the toner cartridge 70 according to the second embodiment of the invention. The toner cartridge 70 has the toner container 74 and the toner container supporting member 3 that has the same configuration as the toner cartridge 1 described above. The toner container portion provided in the toner container 74 has the first container portion 71 and the second container portion 72 which are filled with replenished toner, the third container portion 73 in which the toner discharging port is formed; and the container-side coupling portion. The third container portion 73 in the toner container 74 has the same configuration as the third container portion 33 of the toner container 2 described above; further, the container-side coupling portion also has the same configuration as container-side coupling portion 6 of the toner container 2. Constructions of the first container portion 71 and the second container portion 72, which are characteristic in the toner cartridge 70, are described below.

The first container portion 71 has the cylindrical outer wall 71*e*, and a partition 71*b* an inner diameter of which becomes smaller as approaching the tip portion 71*a* in the axial direction, in other words, as becoming farther from the toner discharging port that is formed in the third container portion 73. In addition, the first container portion 71 includes the inner chamber 711 formed by being surrounded by the partition 71*b*; and the outer chamber 712 formed by being surrounded by the outer wall 71*e* and an outer surface of the partition 71*b*. In this case, the bottom surface of the tip portion 71*a* in the inner chamber 711 formed by being surrounded by the partition 71*b* has an approximately truncated cone shape as a polygon shape. Furthermore, the partition 71*b* has a communication port 71*d* to be an opening through which toner is replenished from the outer chamber 712 to the inner chamber 711, at the tip portion 71*a* thereof. Moreover, between the outer wall 71*e* and the partition 71*b*, a toner scooping member 71*c* with a triangular plate shape is provided in a position adjacent to the communication port 71*d*. The toner scooping member 71*c* scoops toner in the outer chamber 712 by a rotation of the toner container 74 and guides it to the communication port 71*d*. In addition, the outer wall 71*e* and the partition 71*b* are formed with smooth surfaces without a projection.

The second container portion 72 has, as in a case of the first container portion 71, the cylindrical outer wall 72*e*, and a partition 72*b* an inner diameter of which becomes smaller as approaching the tip portion 72*a* in the axial direction, that is, as becoming farther from the toner discharging port that is formed in the third container portion 73. In addition, the second container portion 72 includes the inner chamber 721 formed by being surrounded by the partition 72*b*; and the outer chamber 722 formed by being surrounded by the outer wall 72*e* and an outer surface of the partition 72*b*. In this case, the inner chamber 721 formed by being surrounded by the partition 72*b* has a configuration in which a bottom surface of the tip portion 72*a* has an approximately truncated cone shape as a polygon shape. Furthermore, the partition 72*b* has a communication port 72*d* to be an opening through which toner is replenished from the outer chamber 722 to the inner chamber 721, at the tip portion 72*a* thereof. Moreover, between the outer wall 72*e* and the partition 72*b*, a toner scooping member 72*c* with a triangular plate shape is provided in a position adjacent to the communication port 72*d*. The toner scooping member 72*c* scoops toner in the outer chamber 722 by a rotation of the toner container 74 and guides it to the communication port 72*d*. In addition, the outer wall 72*e* and the partition 72*b* are formed with smooth surfaces without a projection.

As described above, in the inner chambers 711 and 721 that are formed by being surrounded by the partitions 71*b* and 72*b*, since the toner flows as a clump by a rotation of the toner container 74 as a result of a construction such that a shape of bottom surfaces of the tip portions 71*a* and 72*a* is an approximately truncated cone shape as a polygon shape, a deposit of the toner in the tip portions 71*a* and 72*a* of the inner chambers 711 and 721 is reduced, and the quantity of the toner remaining in the toner container 74 can be reduced.

Furthermore, since the toner cartridge 70 has the same configuration as the above toner cartridge 1, the toner cartridge 70 can be mounted on the above process unit 10.

Figure 15:
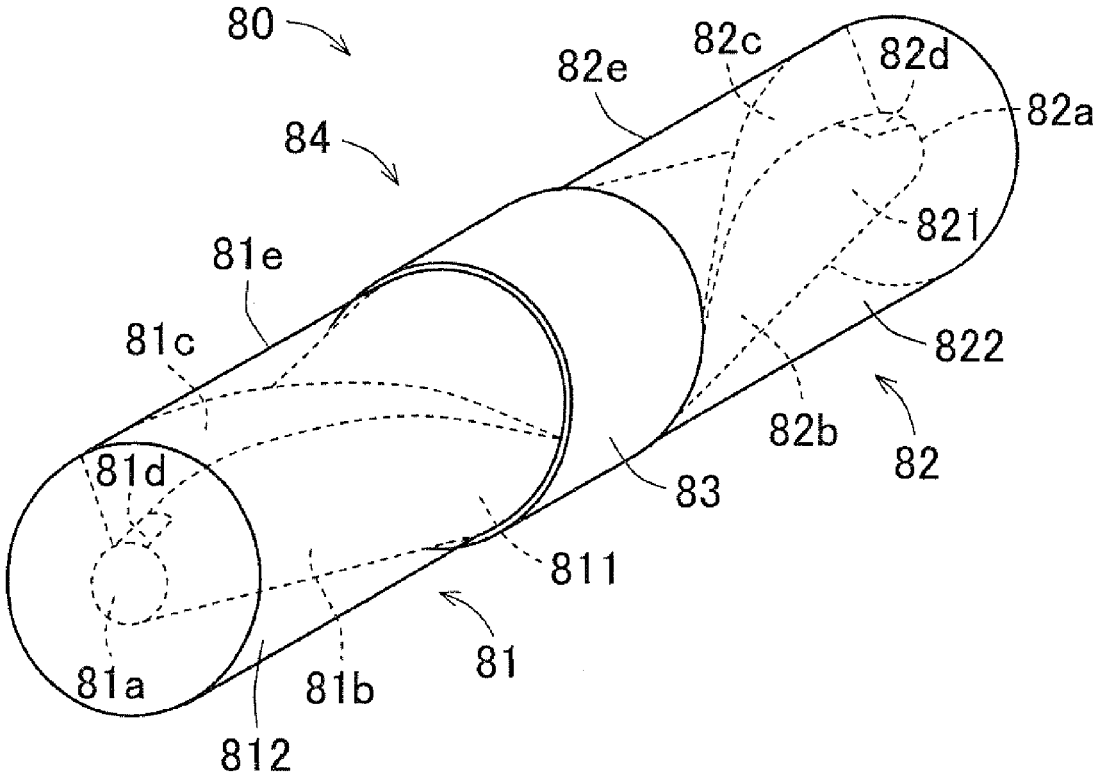
FIG. 15 is a perspective view showing the structure of a toner cartridge according to a third embodiment of the invention.

FIG. 15 is a perspective view showing the structure of the toner cartridge 80 according to the third embodiment of the invention. The toner cartridge 80 has the toner container 84 and the toner container supporting member 3 that has the same configuration as the toner cartridge 1 described above. The toner container portion provided in the toner container 84 has the first container portion 81 and the second container portion 82 which are filled with replenished toner, the third container portion 83 in which the toner discharging port is formed; and the container-side coupling portion. The third container portion 83 in the toner container 84 has the same configuration as the third container portion 33 of the toner container 2 described above, further, the container-side coupling portion also has the same configuration as the container-side coupling portion 6 of the toner container 2. Constructions of the first container portion 81 and the second container portion 82, which are characteristic in the toner cartridge 80, are described below.

The first container portion 81 has the cylindrical outer wall 81*e*, and a partition 81*b* an inner diameter of which becomes smaller as approaching the tip portion 81*a* in the axial direction, that is, as becoming farther from the toner discharging port that is formed in the third container portion 83. In addition, the first container portion 81 includes the inner chamber 811 of a truncated cone shape formed by being surrounded by the partition 81*b*; and the outer chamber 812 formed by being surrounded by the outer wall 81*e* and an outer surface of the partition 81*b*. In this case, the inner chamber 811 formed by being surrounded by the partition 81*b* has a configuration in which a bottom surface of the tip portion 81*a* has a circle shape. Furthermore, the partition 81*b* has a communication port 81*d* to be an opening through which toner is replenished from the outer chamber 812 to the inner chamber 811, at the tip portion 81*a* thereof. Moreover, between the outer wall 81*e* and the partition 81*b*, a toner scooping member 81*c* is provided in a position adjacent to the communication port 81*d*. The toner scooping member 81*c* is provided adjacent to a communication port 81*d* over an entire length in the axial direction, and is a plate-shaped member extending from the partition 81*b* toward the outer wall 81*e*; and is continuously formed in a spiral shape rotating about the axial of the first container portion 81. And the toner scooping member 81*c* scoops toner in the outer chamber 812 by a rotation of the toner container 84 and guides it to the communication port 81*d*. In addition, the outer wall 81*e* and the partition 81*b* are formed with smooth surfaces without a projection.

The second container portion 82 has, as in a case of the first container portion 81, the cylindrical outer wall 82*e*, and a partition 82*b* an inner diameter of which becomes smaller as approaching the tip portion 82*a* in the axial direction, that is, as becoming farther from the toner discharging port that is formed in the third container portion 83. Also, the second container portion 82 includes the inner chamber 821 of a truncated cone shape formed by being surrounded by the partition 82*b*, and the outer chamber 822 formed by being surrounded by the outer wall 82*e* and an outer surface of the partition 82*b*. In this case, the inner chamber 821 formed by being surrounded by the partition 82*b* has a configuration in which a bottom surface of the tip portion 82*a* has is a circle shape. Also, the partition 82*b* has a communication port 82*d* to be an opening through which toner is replenished from the outer chamber 822 to the inner chamber 821, at the tip portion 81*a* thereof. Further, between the outer wall 82*e* and the partition 82*b*, a toner scooping member 82*c* is provided in a position adjacent to the communication part 82*d*. The toner scooping member 82*c* is provided adjacent to a communication port 82*d* over an entire length in the axial direction, and is a plate-shaped member extending from the partition 82*b* toward the outer wall 82*e*; and is continuously formed in a spiral shape rotating about the axis of the second container portion 82. And the toner scooping member 82*c* scoops toner in the outer chamber 822 by a rotation of the toner container 84 and guides it to the communication port 82*d*. In addition, the outer wall 82*e* and the partition 82*b* are formed with smooth surfaces without a projection.

As described above, the toner scooping members 81*c* and 82*c* can convey all toners in the outer chambers 812 and 822 toward the communication ports 81*d* and 82*d*, by being formed with no space between the partitions 81*b*, 82*b* and the outer walls 81*e*, 82*e* in the entire length in the axial direction. In addition, since the toner scooping members 81*c* and 82*c* are continuously formed in a spiral shape rotating about the axis of each container portion 81 and 82, the toner scooping members 81*c* and 82*c* are able to not only scoop the toner in the outer chambers 812 and 822 but also push out the toner toward the communication port 82*d* and rapidly convey the toner in the outer chambers 812 and 822 toward the communication ports 81*d* and 82*d*.

Further, the toner cartridge 80 can be mounted on the process unit 10 since it has the same configuration as the toner cartridge 1 described above.

Figure 16:
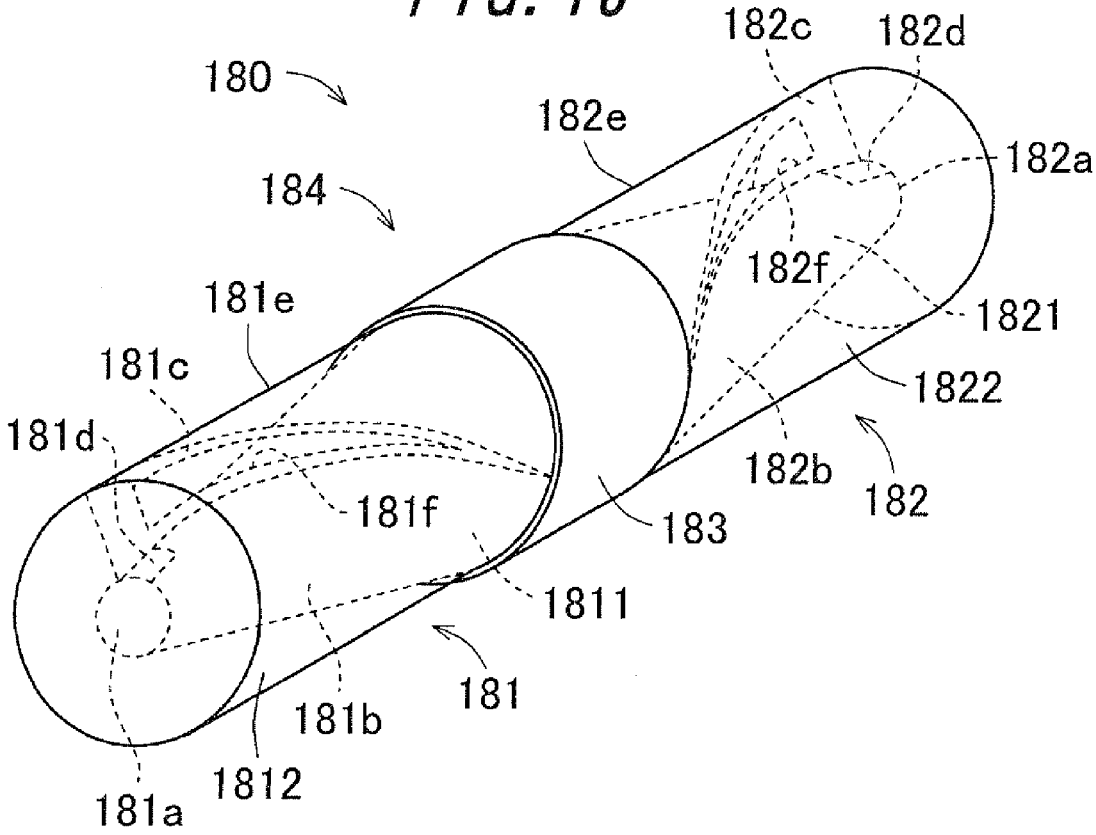
FIG. 16 is a perspective view showing the structure of a toner cartridge according to a fourth embodiment of the invention.

FIG. 16 is a perspective view showing the structure of a toner cartridge 180 according to the fourth embodiment of the invention. The toner cartridge 180 has the toner container 184 and the toner container supporting member 3 that has the same configuration as the toner cartridge 1 described above. The toner container portion provided in the toner container 184 has the first container portion 181 and the second container portion 182 which are filled with replenished toner, the third container portion 183 in which the toner discharging port is formed; and the container-side coupling portion. The third container portion 183 in the toner container 184 has the same configuration as the third container portion 33 of the toner container 2 described above; further, the container-side coupling portion also has the same configuration as container-side coupling portion 6 of the toner container 2. Constructions of the first container portion 181 and the second container portion 182, which are characteristic in the toner cartridge 180, are described below.

The first container portion 181 has the cylindrical outer wall 181*e*, and a partition 181*b* an inner diameter of which becomes smaller as approaching the tip portion 181*a* in the axial direction, that is, as becoming farther from the toner discharging port that is formed in the third container portion 183. Also, the first container portion 181 includes the inner chamber 1811 formed by being surrounded by the partition 181*b*; and the outer chamber 1812 formed by being surrounded by the outer wall 181*e* and an outer surface of the partition 181*b*. In this case, the inner chamber 1811 formed by being surrounded by the partition 181*b* has a configuration in which a bottom surface of the tip portion 181*a* has a circular shape. Also, the partition 181*b* has a communication port

181*d* to be an opening through which toner is replenished from the outer chamber 1812 to the inner chamber 1811, at the tip portion 181*a* thereof. Further, between the outer wall 181*e* and the partition 181*b*, a toner scooping member 181*c* is provided in a position adjacent to the communication port 181*d*. The toner scooping member 181*c* is provided adjacent to a communication port 181*d* over an entire length in the axial direction, and is a plate-shaped member extending from the partition 181*b* toward the outer wall 181*e*, has a notch 181*f* of an approximate triangle; and is continuously formed in a spiral shape rotating about the axial of the first container portion 181. Furthermore, the toner scooping member 181*c* scoops toner in the outer chamber 1812 by a rotation of the toner container 184 and guides it to the communication port 181*d*. In this case, the toner scooping member 181*c* is formed with a notch 181*f* in a middle of a surface thereof; then, a part of toner in the outer chamber 1812 passes through the notch. As a result, toner in the outer chamber 1812 is kept in fluidized state without coagulation. An area of the notch 181*f* is set in view of a scooping performance to scoop toner in the outer chamber 1812 and a conveying performance to convey toner by guiding it to the communication port 181*d*. In addition, the outer wall 181*e* and the partition 181*b* are formed with smooth surfaces without a projection.

The second container portion 182 has, as in a case of the first container portion 181, the cylindrical outer wall 182*e*, and a partition 182*b* an inner diameter of which becomes smaller as approaching the tip portion 182*a* in the axial direction, that is, as becoming farther from the toner discharging port that is formed in the third container portion 183. In addition, the second container portion 182 includes the inner chamber 1821 formed by being surrounded by the partition 182*b*; and the outer chamber 1822 formed by being surrounded by the outer wall 182*e* and an outer surface of the partition 182*b*. In this case, the inner chamber 1821 formed by being surrounded by the partition 182*b* has a configuration in which a bottom surface of the tip portion 182*a* has a circular shape, Furthermore, the partition 182*b* has a communication port 182*d* to be an opening through which toner is replenished from the outer chamber 1822 to the inner chamber 1821, at the tip portion 182*a* thereof. Moreover, between the outer wall 182*e* and the partition 182*b*, a toner scooping member 182*c* is provided in a position adjacent to the communication port 182*d*. In addition, between the outer wall 182*e* and the partition 182*b*, a toner scooping member 182*c* is provided in a position adjacent to the communication port 182*d*. The toner scooping member 182*c* is provided adjacent to a communication port 182*d* over an entire length in the axial direction, and is a plate-shaped member extending from the partition 182*b* toward the outer wall 182*e*, has a notch 182*f* of an approximate triangle; and is continuously formed in a spiral shape rotating about the axis of the second container portion 182. Furthermore, the toner scooping member 182*c* scoops toner in the outer chamber 1822 by a rotation of the toner container 184 and guides it to the communication port 182*d*. In this case, the toner scooping member 182*c* is formed with a notch 182*f* in a middle of a surface thereof; then, a part of toner in the outer chamber 1822 passes through the notch. As a result, toner in the outer chamber 1822 is kept in fluidized state without coagulation. An area of the notch 182*f* is set in view of a scooping performance to scoops toner in the outer chamber 1822 and a conveying performance to convey toner by guiding it to the communication port 182*d*. In addition, the outer wall 182*e* and the partition 182*b* are formed with smooth surfaces without a projection.

As described above, the toner scooping members 181*c* and 182*c* can convey all toners in the outer chambers 1812 and 1822 toward the communication ports 181*d* and 182*d*, by being formed with no space between the partitions 181*b*, 182*b* and the outer walls 181*e*, 182*e* in the entire length in the axial direction. In addition, since the toner scooping members 181*c* and 182*c* are continuously formed in a spiral shade rotating about the axis of each container portion 181 and 182, the toner scooping members 181*c* and 182*c* are able to not only scoop the toner in the outer chambers 1812 and 1822 but also push out the toner toward the communication port 182*d* and rapidly convey the toner in the outer chambers 1812 and 1822 toward the communication ports 181*d* and 182*d*.

Further, the toner cartridge 180 can be mounted on the process unit 10 since it has the same configuration as the toner cartridge 1 described above.

Figure 17:
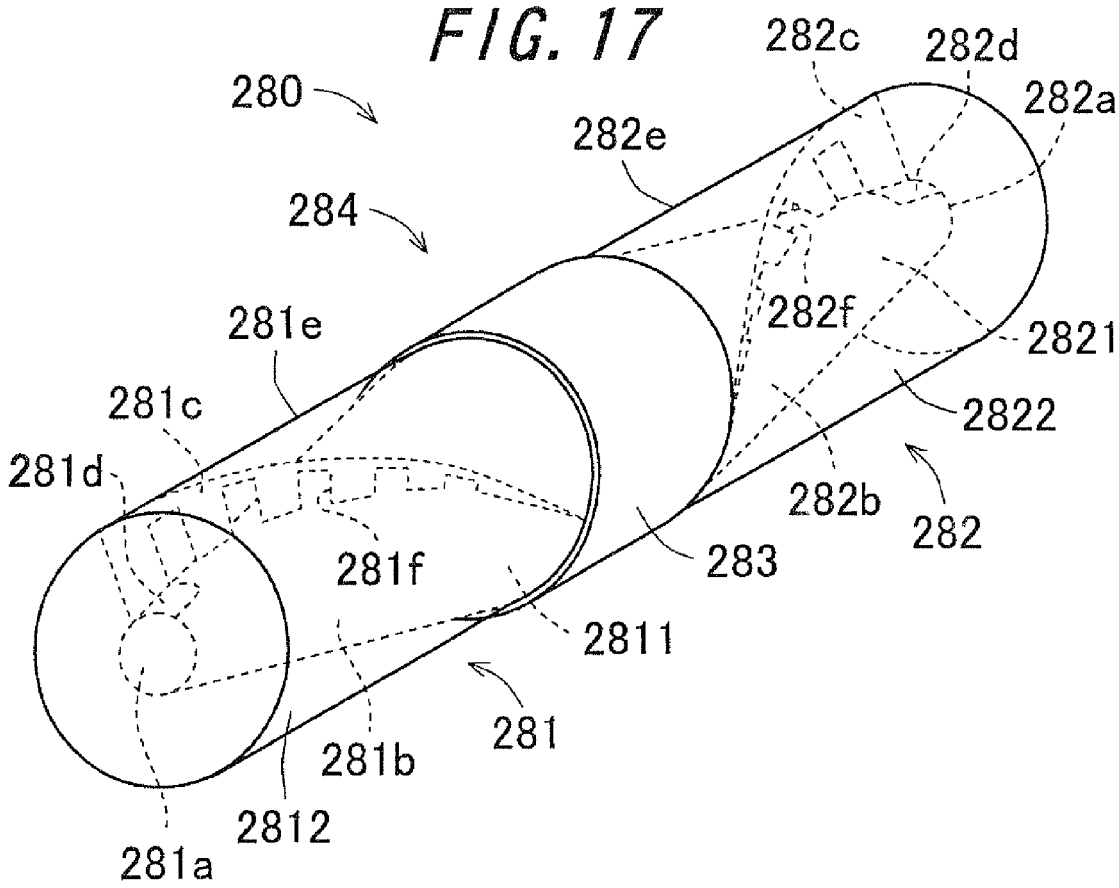
FIG. 17 is a perspective view showing the structure of a toner cartridge according to a fifth embodiment of the invention.

FIG. 17 is a perspective view showing a toner cartridge 280 according to the fifth embodiment of the invention. The toner cartridge 280 has the toner container 284 and the toner container supporting member 3 that has the same configuration as the toner cartridge 1 described above. The toner container portion provided in the toner container 284 has the first container portion 281 and the second container portion 282 which are filled with replenished toner, the third container portion 283 in which the toner discharging port is formed; and the container-side coupling portion. The third container portion 283 in the toner container 284 has the same configuration as the third container portion 33 of the toner container 2 described above; further, the containers side coupling portion also has the same configuration as the container-side coupling portion 6 of the toner container 2. Constructions of the first container portion 281 and the second container portion 282, which are characteristic in the toner cartridge 280, are described below.

The first container portion 281 has the cylindrical outer wall 281*e*, and a partition 281*b* an inner diameter of which becomes smaller as approaching the tip portion 281*a* in the axial direction, that is, as becoming farther from the toner discharging port that is formed in the third container portion 283. Also, the first container portion 281 includes the inner chamber 2811 formed by being surrounded by the partition 281*b*; and the outer chamber 2812 formed by being surrounded by the outer wall 281*e* and an outer surface of the partition 281*b*. In this case, the inner chamber 2811 formed by being surrounded by the partition 281*b* has a configuration in which a bottom surface of the tip portion 281*a* has a circular shape. Also, the partition 281*b* has a communication port 281*d* to be an opening through which toner is replenished from the outer chamber 2812 to the inner chamber 2811, at the tip portion 281*a* thereof. Further, between the outer wall 281*e* and the partition 281*b*, a toner scooping member 281*c* is provided in a position adjacent to the communication port 281*d*. The toner scooping member 281*c* is provided adjacent to a communication port 281*d* over an entire length in the axial direction, and is a plate-shaped member formed in a comb-like shape extending from the partition 281*b* toward the outer wall 281*e*, is provided as such a plurality of notches 281*f* of an approximate rectangular is open on a side of the partition 281*b*; and is continuously formed in a spiral shape rotating about the axis of the first container portion 281. In addition, the notch portion 281*f* can be provided as such it is open on the outer wall 281*e*. Then, the toner scooping member 281*c* scoops toner in the outer chamber 2812 by a rotation of the toner container 284 and guides it to the communication port 281*d*. In this case, the toner scooping member 281*c* is formed in the comb-like shape; thus, the toner in the outer chamber 2812 is broken and can be prevented from coagulating. An area of the notch 2831*f* is set in view of a scooping performance to scoop toner in the outer chamber 2812 and a conveying performance to convey toner by guiding it to the communication port 281*d*. In addition, the outer wall 281*e* and the partition 281*b* are formed with smooth surfaces without a projection.

The second container portion 282 has, as in a case of the first container portion 281, the cylindrical outer wall 282*e*, and a partition 282*b* an inner diameter of which becomes smaller as approaching the tip portion 282*a* in the axial direction, in other words, as becoming farther from the toner discharging port that is formed in the third container portion 283. Also, the second container portion 282 includes the inner chamber 2821 formed by being surrounded by the partition 282*b*; and the outer chamber 2822 formed by being surrounded by the outer wall 282*e* and an outer surface of the partition 282*b*. In this case, the inner chamber 2821 formed by being surrounded by the partition 282*b* has a configuration in which a bottom surface of the tip portion 282*a* has a circular shape. Also, the partition 281*b* has a communication port 282*d* to be an opening through which toner is replenished from the outer chamber 2822 to the inner chamber 2821, at the tip portion 281*a* thereof. Further, between the outer wall 282*e* and the partition 282*b*, a toner scooping member 282*c* is provided in a position adjacent to the communication port 282*d*. The toner scooping member 282*c* is provided adjacent to a communication port 282*d* over an entire length in the axial direction, and is a plate-shaped member formed in a comb-like shape extending from the partition 282*b* toward the outer wall 282*e*, is provided as such a plurality of notches 282*f* of an approximate rectangular is open on a side of the partition 282*b*; and is continuously formed in a spiral shape rotating about the axis of the second container portion 282. In addition, the notch portion 282*f* can be provided as such it is open on the outer wall 282*e*. Then, the toner scooping member 282*c* scoops toner in the outer chamber 2822 by a rotation of the toner container 284 and guides it to the communication port 292*d*. In this case, the toner scooping member 282*c* is formed in the comb-like shape; thus, the toner in the outer chamber 2822 is broken and can be prevented from coagulating. An area of the notch 262*f* is set in view of a scooping performance to scoop toner in the outer chamber 2822 and a conveying performance to convey toner by guiding it to the communication port 282*d*. In addition, the outer wall 282*e* and the partition 282*b* are formed with smooth surfaces without a projection.

As described above, the toner scooping members 282*c* and 282*c* can convey all toners in the outer chambers 2812 and 2822 toward the communication ports 281*d* and 282*d*, by being formed with no space between the partitions 281*b*, 282*b* and the outer walls 281*e*, 282*e* in the entire length in the axial direction. In addition, since the toner scooping members 281*c* and 282*c* are continuously formed in a spiral shape rotating about the axis of each container portion 281 and 282, the toner scooping members 281*c* and 282*c* are able to not only scoop the toner in the outer chambers 2812 and 2822 but also push out the toner toward the communication port 282*d* and rapidly convey the toner in the outer chambers 2812 and 2822 toward the communication ports 281*d* and 282*d*.

Further, the toner cartridge 280 can be mounted on the process unit 10 since it has the same configuration as the toner cartridge 1 described above.

Figure 18:
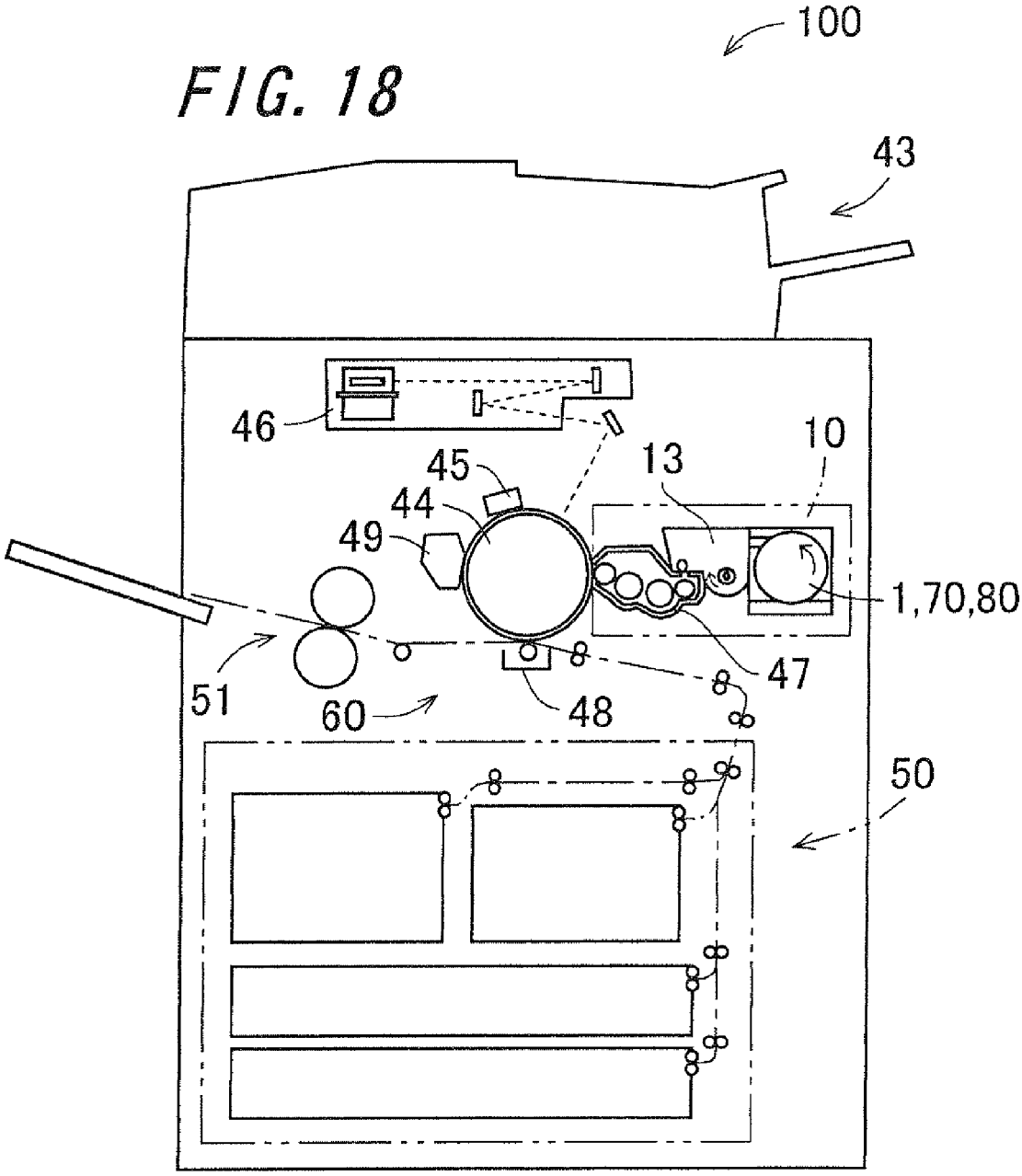
FIG. 18 is a view showing the structure of an image forming apparatus according to an embodiment of the invention.

FIG. 18 is a view showing the structure of the image forming apparatus 100 according to an embodiment of the invention. The image forming apparatus 100 is an apparatus that forms an image on a surface of a recording medium such as a recording paper and obtain a printed material. The image forming apparatus 100 comprises an electrophotographic process portion 60 and a sheet supply portion 50. The electrophotographic process portion 60 comprises a photoreceptor drum 44, a charging portion 45, an exposure portion 46, the process unit 10, a transfer portion 48, a cleaning portion 49, and a fixing portion 51, and forms an image on a surface of the recording medium supplied from the sheet supply portion 50.

The photoreceptor drum 44 is supported so as to be rotatable about an axis thereof by a driving portion (not shown) and comprises a cylindrical-shaped or columnar-shaped conductive substrate (not shown) and a photosensitive layer formed on the surface of the conductive substrate. As the photoreceptor drum 44, a photoreceptor drum commonly used in this field may be used, and an example thereof includes one containing an aluminum pipe as the conductive substrate and an organic photosensitive layer formed on the surface of the aluminum pipe. The organic photosensitive layer is composed by laminating a charge generating layer containing a charge generating substance and a charge conveying layer containing a charge conveying substance. The organic photosensitive layer may include the charge generating substance and the charge conveying substance in a layer.

The charging portion 45 charges the surface of the photoreceptor drum 44 with a predetermined polarity and at a predetermined potential. In the embodiment, a charging roller is used as the charging portion 45, but without limitation thereto, for example, it is possible to use a brush-type charging device, a charger-type charging device, a corona charging device such as a scorotron charger, and the like. The exposure portion 46 irradiates the surface of the photoreceptor drum 44 in a charged state with signal light corresponding to image information of a document read by a scanner 43, and forms an electrostatic image corresponding to the image information on the surface of the photoreceptor drum 44. For the exposure portion 46, a laser beam scanner and the like are used.

In the process unit 10, the toner cartridge 1 supplies toner to the toner hopper 13 by rotation of the toner cartridge 1 and the toner hopper 13 supplies toner to the developing section 47 depending on the toner consumption in the developing section 47. The developing section 47 supplies toner to the surface of the photoreceptor drum 44 and visualizes an electrostatic latent image formed on the surface of the photoreceptor drum 44 to form a toner image.

The transfer portion 48 is brought into pressure-contact with the surface of the photoreceptor drum 44, and, in synchronization with reaching of the toner image on the photoreceptor drum 44 to a pressure-contact region of the photoreceptor drum 44 and the transfer portion 48, transfers the toner image on the surface of the photoreceptor drum 44 on the recording medium conveyed from the sheet supply portion 50 described below to the pressure-contact region of the photoreceptor drum 44 and the transfer portion 48, by applying pressure to the toner image. For the transfer portion 48, for example, a transfer roller is used.

The fixing portion 51 fixes the toner image carried on the recording medium by the transfer portion 48 to the recording medium with heat and pressure. The cleaning portion 49 is provided so as to be brought into contact with the surface of the photoreceptor drum 44, and removes toner, paper powder and the like remaining on the surface of the photoreceptor drum 44 after the toner image is transferred to the recording medium to clean the surface of the photoreceptor drum 44.

According to the electrophotographic process portion 60, after charging the surface of the photoreceptor drum 44 that rotates about the axis thereof by the charging portion 45, the surface thereof is irradiated with signal light corresponding to image information by the exposure portion 46 so that an electrostatic image is formed thereon. Then, the process unit 10 supplies toner to the electrostatic image to obtain a toner image, and the toner image is transferred to a recording medium by the transfer portion 48. The toner image is fixed to the recording medium by applying heat and pressure by means of the fixing portion 51. The recording medium having the image formed thereon in this way is fed to outside the image forming apparatus 100. Meanwhile, the surface of the photoreceptor drum 44 after transfer of the toner image is cleaned by the cleaning portion 49. The series of processes is repeated to form an image.

The sheet supply portion 50 comprises a sheet cassette for storing a recording medium and a sheet feed path serving as a passage in which a recording medium is conveyed. The recording medium stored in the sheet cassette is conveyed through the sheet feed path to the contact region of the photoreceptor drum 44 and the transfer portion 48 in the electrophotographic process portion 60 and conveyed to the fixing portion 51.

The image forming apparatus 100 can form an image on a recording medium in the state where toner can be efficiently supplied to the photoreceptor drum 44, since an electrostatic latent image on a surface of the photoreceptor drum 44 is developed by the process unit 10 provided with the toner cartridge 1, 70, 80, 180 or 280 of the invention that can reduce the quantity of toner remaining without being discharged. Further, since the image forming apparatus 100 develops an electrostatic latent image on a surface of the photoreceptor drum 44 by the process unit 10 provided with the toner cartridge 1, 70 or 80 that can reduce the quantity of residual toner, and are easily recycled and environmentally friendly, the apparatus as a whole is environmentally friendly.

The embodiment described above is only an exemplification of the invention, and thus the construction of the invention can be modified within the scope of the invention. For example, the toner cartridges 1, 70, 80, 180 and 280 according to the invention have been exemplified as being applicable to the image forming apparatus 100. However, the image forming apparatus 100, to which the toner cartridges 1, 70, 80, 180 and 280 according to the invention are applicable, is not limited to the image forming apparatus 100 having the construction described above and can be developed to other image forming apparatuses and the like, provided that they are image forming apparatuses in which a toner replenishing apparatus or a developing apparatus is mounted and to which toner needs to be replenished from a toner cartridge.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner cartridge mounted removably in an image forming apparatus, comprising:

a toner container, formed into a cylindrical shape, for containing a toner for use as a developer in image formation, the toner container having a toner discharging port through which the toner is discharged and conveying the contained toner toward the toner discharging port by rotation of the toner container about an axis thereof; and a toner container supporting member for supporting the toner container rotatably about the axis thereof, throughout a whole circumference from an outer side in a radial direction of the toner container, the toner container supporting member having a toner through hole for guiding the toner discharged from the toner discharging port to the outside of the toner cartridge, the toner container including a cylindrical outer wall and a cylindrical partition provided inside the cylindrical outer wall and attached to the cylindrical outer wall so that the cylindrical partition rotates together with the cylindrical outer wall, an inner diameter of which becomes smaller with distance from the toner discharging port in an axial direction of the toner container, the toner container having an inner chamber formed by being surrounded by the cylindrical partition and an outer chamber formed by being surrounded by the cylindrical outer wall and an outer surface of the cylindrical partition, the cylindrical partition having a communication port arranged at a position distant from the toner discharging port in the axial direction and used as an opening through which the toner is supplied from the outer chamber toward the inner chamber, and between the cylindrical outer wall and the cylindrical partition, a toner scooping member being arranged for scooping the toner in the outer chamber and guiding the toner to the communication port by the rotation of the toner container.

2. The toner cartridge of claim 1, wherein the communication port in the cylindrical partition is arranged at a farthest position from the toner discharging port in the axial direction.

3. The toner cartridge of claim 1, wherein the inner chamber has a truncated cone shape.

4. The toner cartridge of claim 1, wherein the inner chamber has a tip portion of an oval shape or a polygonal shape.

5. The toner cartridge of claim 1, wherein the toner scooping member is provided adjacently to the communication port over an entire length in the axial direction and is a plate-shaped member extending from the cylindrical partition toward the cuter wall.

6. The toner cartridge of claim 5, wherein the toner scooping member is continuously formed spirally around the axis of the toner container.

7. The toner cartridge of claim 6, wherein the toner scooping member is formed with a notch in a middle of the surface thereof.

8. The toner cartridge of claim 6, wherein the toner scooping member is formed in a comb-like shape.

9. A process unit for forming a toner image by supplying toner as a developer to a surface of a photoreceptor included in an image forming apparatus aid visualizing an electrostatic latent image formed on the surface of the photoreceptor, comprising:

the toner cartridge of claim 1 that contains toner therein; and a developing section for developing the electrostatic latent image by supplying toner to the surface of the photoreceptor.

10. An image forming apparatus carrying out an image formation by electrophotography, comprising:

a photoreceptor as an image bearing member;

a charging portion for charging a surface of the photoreceptor;

an exposure portion for irradiating a surface of the photoreceptor in a charged state with a signal light corresponding to an image information to form an electrostatic latent image; and the process unit of claim 9, for forming a toner image by supplying toner as a developer to the electrostatic latent image on the surface of the photoreceptor.

* * * * *